United States Patent [19]

Kaenel

[11] 4,131,948

[45] Dec. 26, 1978

[54] ELECTRONIC BOWLING SCORING SYSTEM WITH BUS COMMUNICATION BETWEEN MANAGER CONSOLE AND LANE SCORE CONSOLES

[75] Inventor: Reginald A. Kaenel, Weston, Conn.

[73] Assignee: AMF Incorporated, White Plains, N.Y.

[21] Appl. No.: 764,431

[22] Filed: Jan. 31, 1977

[51] Int. Cl.[2] ..... G06F 3/00

[52] U.S. Cl. ..... 364/900; 364/411; 273/54 C

[58] Field of Search ... 364/200 MS File, 900 MS File, 364/410, 411; 235/92 GA, 151; 340/323 B; 273/54 C

[56] References Cited

U.S. PATENT DOCUMENTS

| | | | |
|---|---|---|---|
| 3,858,198 | 12/1974 | Ross | 340/324 AD |
| 3,907,290 | 9/1975 | Fisher et al. | 273/54 C |

*Primary Examiner*—Gareth D. Shaw

*Assistant Examiner*—Thomas M. Heckler

*Attorney, Agent, or Firm*—Schuyler, Birch, Swindler, McKie & Beckett

[57] ABSTRACT

An automatic bowling scoring system is disclosed including a central manager's console unit linked in parallel over a plurality of communication buses with a plurality of lane score processors having printing and CRT display monitor units. The manager's console sends commands to the score processors, and thereby gains control over the execution sequences followed by each score processor and modifies its functional sequence. In particular, the manager's console is capable of selectively controlling the display at any lane pair processor, to cause display of locally generated game score information, or supplementary information developed at the manager's console. The manager's console can also cause the transfer of the locally generated game score information on any monitor to be routed over the buses to the manager's console display monitor.

9 Claims, 8 Drawing Figures

| KEY | FUNCTION | SET | RESET | LIST |
|---|---|---|---|---|
| C | CLEAR | EXECUTE | | CLEAR PENDING |
| R | REMOVE SCORE | EXECUTE | | REMOVE SCORE PENDING |
| | PRINT AT LANE | EXECUTE | X | PRINTERS PRINTING |
| | PRINT AT CONSOLE | EXECUTE | STOP | |
| | SELECT OPEN OR LEAGUE | EXECUTE | ENABLE SELECT | UNIT IN OPEN OR LEAGUE MODE |
| D | DISPLAY LANE NUMBER | EXECUTE | RESTORE TEXT | |
| | DISPLAY ADVERTISEMENT | X | X | UNIT WITH FUNCTION INHIBITED OR ENABLED |
| S | INHIBIT CLEAR | X | X | |
| V | INHIBIT PRINTER | X | X | |
| B | INHIBIT AUTOSEQUENCING | X | X | |
| O | INHIBIT OPEN LEAGUE SELECT | X | X | |
| | BLANK OUT SCREEN | X | X | UNITS IN PARTICULAR STATE OR NOT IN THAT STATE. |
| Z | DISABLE LANE | X | X | |
| | PRACTICE PLAY | X | X | |
| E | POWER UNIT | X | X | |
| U | IDLE LANES | | | X |
| Y | GAMES COMPLETING | | | X |
| | PAGING MESSAGES | ENABLE KEYBOARD | RESTORE TEXT | TEXT DISPLAY |
| | DISPLAY LANE | SELECT LANE | | DISPLAY IMAGE |
| N | DISPLAY LANES IN SEQUENCE | SELECT GROUP OF LANES | STOP SEQUENCING | DELAY SEQUENCE OF IMAGES |

FIG. 7

ELECTRONIC BOWLING SCORING SYSTEM WITH BUS COMMUNICATION BETWEEN MANAGER CONSOLE AND LANE SCORE CONSOLES

BACKGROUND OF THE INVENTION

Bowling score devices, both electromechanical and electronic have been proposed and developed for automatically computing and displaying bowling scores. However, the full benefits of electronic score processing can be realized only if all lane score processing units are in communication with a central manager's station. In this way the manager can monitor and control the activity at each lane. A prior art effort in this direction is disclosed in Fischer U.S. Pat. No. 3,907,290.

Fischer discloses a bowling scoring system wherein a central control unit controls the computing and display of game scores at all lanes. The processor of a central unit communicates through an interface with the memories at each lane pair console so that they serve as the memory for the central processor. Each lane pair console, in addition to the lane pair memory, has a character generator for driving a CRT display and keyboard and automatic pin sensor inputs. The only display at each lane is a CRT display. A single central printer is located at the central processor. The central processor has no game score data memory of its own. No game score processing can occur at any lane. Therefore, the system has the limitation that score processing and display at each lane must await its shared time at the central processor. Further, since a single printer is located at the central processor, printing is also delayed. It has been found that this seemingly simplified approach results in a scoring system which is unnecessarily expensive to build and maintain because of the redundancy which must be provided at the central processor both for processor and printer lest the entire system break down with the failure of any single component at the manager's station. Moreover, no specific means are disclosed for transferring video display material between the manager's console and the lane score processors, to maintain the manager's communication with and supervision over individual lanes.

A similar earlier effort is disclosed in Walker U.S. Pat. No. 3,700,236, which discloses a system having a single computation means for a plurality of lanes, each lane pair may be selectively set for open or league mode of bowling All computation is carried out at the single computation center, with the computed score results being transmitted to a printer at each lane. This system suffers from the same deficiency of centralizing all score processing at a single central unit with its attendant delays in processing and the risk of a breakdown of the entire house with any failure at the manager's station.

SUMMARY OF THE INVENTION

The subject invention comprises a manager's console for a bowling establishment which provides administrative control over individual scoring consoles provided at each lane pair. The manager's console communicates with the individual score processing consoles over four communication cable buses by which the console can selectively communicate with any individual score processing unit of all of the score processing units by (1) sending commands; (2) receiving data; (3) sending video signals to be displayed at the CRT monitors at a selected score console; or (4) receiving video signals from a score console instructed to transmit such a signal on the video bus. By the transmission of commands including lane score console address codes, register address codes, command and data codes from the manager's console to any identified score processor unit, the manager is able to exercise supervisory control over the processing functions occurring at any lane. By transmitting a video signal over the communicatiion cable bus, the manager console is able to display messages at any identified score processing console. By sending the proper command word to an identified score console, the manager console is able to cause that console to emit the video display, i.e., the game score data currently appearing on the monitor at that identified lane.

As a result of the provision of these functions, the manager's console exercises supervisory control over the entire bowling establishment. However, because individual scoring consoles are provided at each lane pair, a breakdown in any single scoring console or at the manager's console will not interfere with the continued operation of the bowling establishment. Further, since the manager's console is fully compatible with the individual bowling scoring consoles, it can be made up from the same components used to construct the individual lane score consoles. The difference in functions can be provided by providing the manager's console with a tailored set of control read only memories programmed to provide the different programming functions to be disclosed herein and which establishes the communication between the manager's console and the individual lane score consoles.

CROSS REFERENCE TO RELATED APPLICATIONS

U.S. application Ser. No. 711,217, Warner, et al, "Bowling Scorer," now U.S. Pat. No. 4,092,727 disclosing a lane pair computer, and U.S. application Ser. No. 725,885, Kaenel, "Printer for Bowling Score Computer," disclosing a printer cooperating with a lane pair score computer, are incorporated herein by reference.

BRIEF DESCRIPTION OF THE DRAWINGS

FIG. 7 is a listing of the significant control functions exercised by the manager's console over the lane score processor units.

DETAILED DESCRIPTION OF A PREFERRED EMBODIMENT

Figure 1:
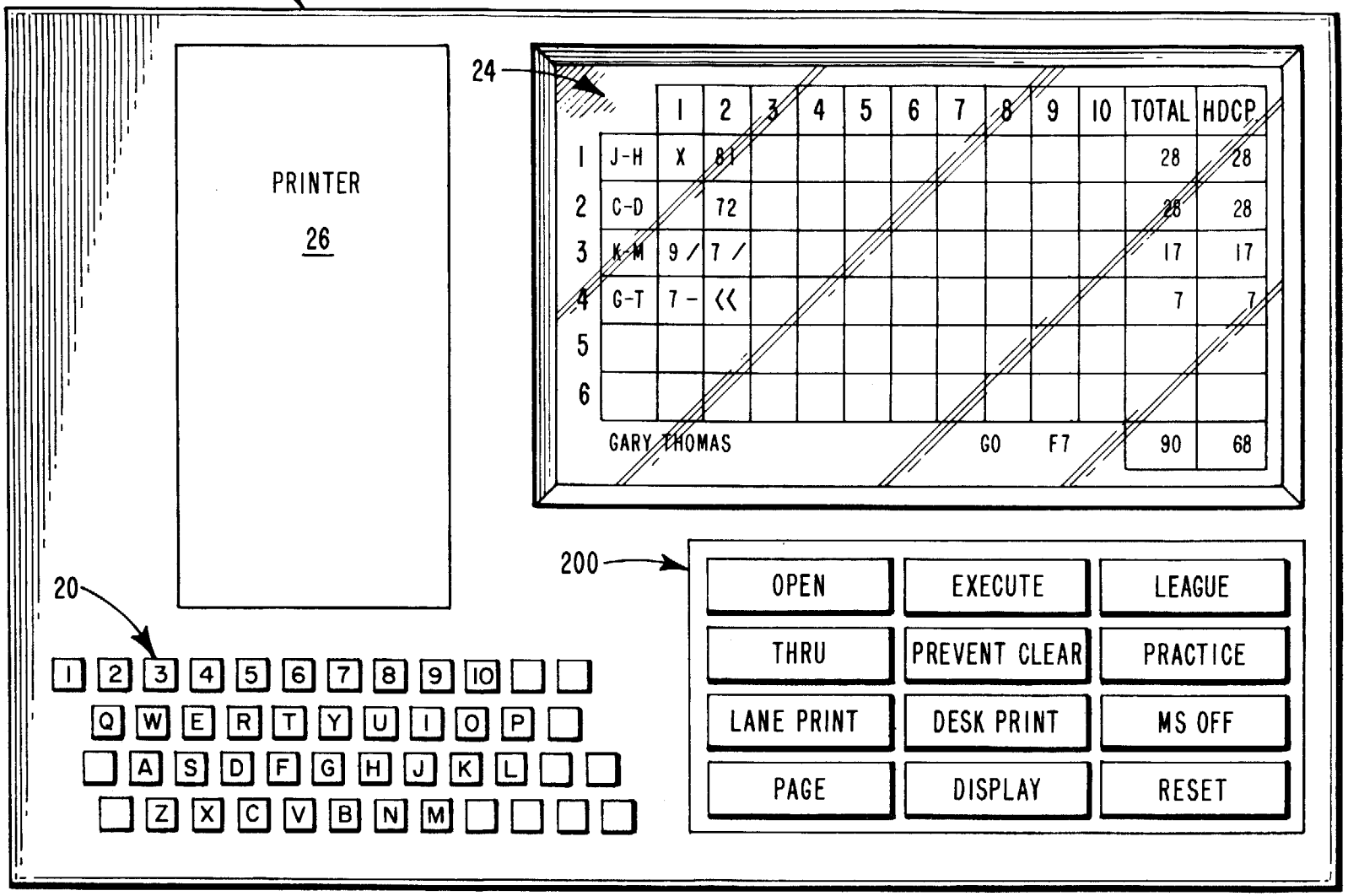
FIG. 1 is a representation of the manager's console including the control keys.
Figure 2:
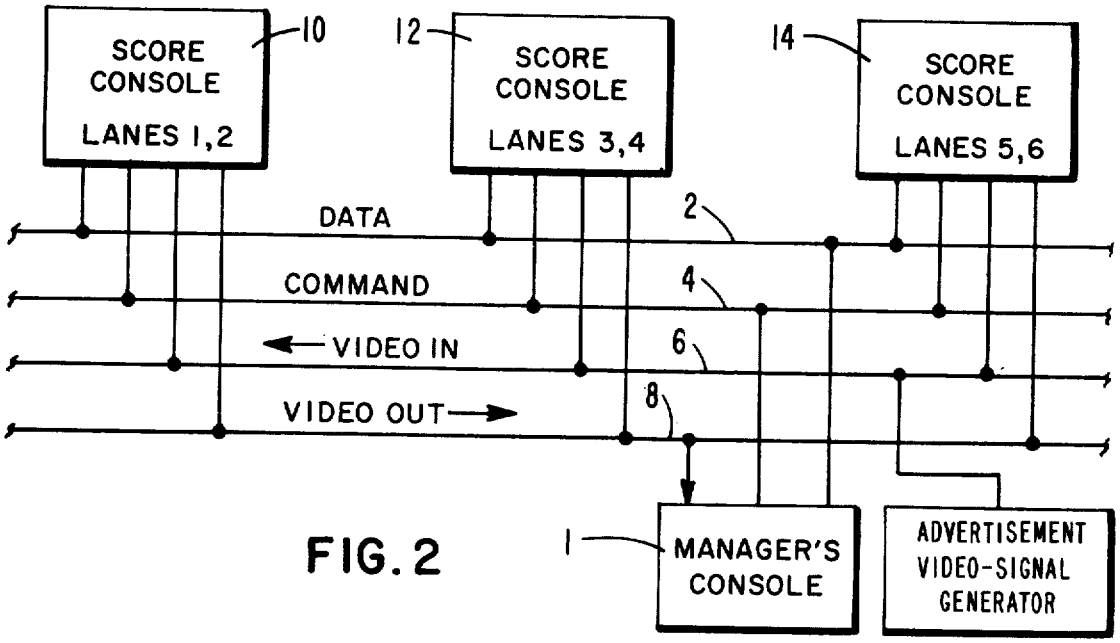
FIG. 2 is a block diagram of the functional relationship of the manager's console with the computer units at the individual lanes.

The disclosed manager's console 1 (FIG. 1) for an automatic scoring system provides administrative control over a plurality of scorer consoles for the bowling proprietor. As shown in FIG. 2, the manager's console 1 is connected in parallel over four communication buses 2, 4, 6, 8 with all the score consoles 10, 12, 14 of the bowling establishment. The manager's console communicates over these buses as follows:

1. The console 1 transmits commands including the identity code of a designated console to the scorers 10, 12, 14 on the command cable 4;

2. It receives data from the addressed scorer 10, 12, 14 instructed to transmit data on the data cable 2;

3. It receives the video signals from the scorer 10, 12, 14 instructed to transmit such a signal on the VIDEO OUT cable 8; and 4. It causes the transmission of video signals to the addressed scorer console 10, 12, 14 on VIDEO IN cable 6.

The score processing units of the scorer consoles 10, 12, 14 communicate over buses 2, 4, 6, 8 as follows:

1. They receive commands (including score console identification codes, command or instruction codes and data codes) on bus 4 in 8-bit long bytes;

2. They transmit 8-bit long data words on bus 4 to manager's console 1;

3. They transmit the video signal of their monitor displays 24L, 24R through a video interface switching circuit (30, FIG. 3) over video cable 8 when instructed to do so by the manager's console 1; and 4. They display on their monitors 24L, 24R a video signal supplied over video cable 6.

It should be understood that three lane consoles 10, 12, 14 are shown only for purposes of example; as many as 49 lane consoles have been successfully used with this system.

Figure 3:
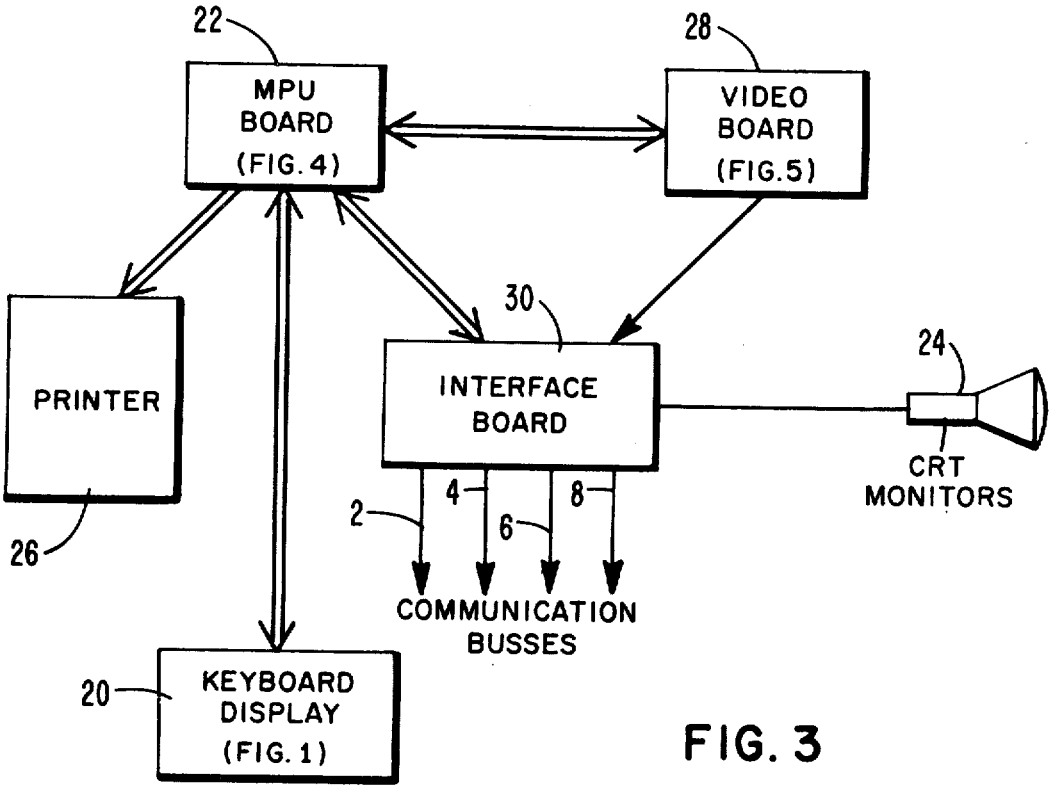
FIG. 3 is a block diagram of the processor components, common to both the manager's console and the lane pair score processors.

As shown in FIG. 3, the manager's console 1 includes a keyboard 20 by which control commands can be initiated and data inserted into the unit; a microprocessor (MPU) board 22 which operates on the commands and information; a cathode ray tube monitor 24 by which the console 1 communicates with the operator and on which the display of a CRT monitor 24L, 24R of any lane score console 10, 12, 14 can be made to appear; a printer 26 by which the score sheet from a lane governed by any score processing unit 10, 12, 14 can be produced; a video board 28 for providing display signals to the CRT monitor; and an interface board 30 for connecting the processor board 22 and the monitor 24 of the manager's console 1 with the processor board 22 and display monitors 24 of any bus connected lane scoring console.

Each lane scoring console 10, 12, 14 includes the same electronic components as included on the manager's console 1. Lane consoles 10, 12, 14 differ from the manager's console 1 only in having a different keyboard; a differently programmed read only memory controlling the microprocessor board 22; and a second CRT monitor 24 so that the game score information on each lane is displayed on a separate monitor.

Figure 4:
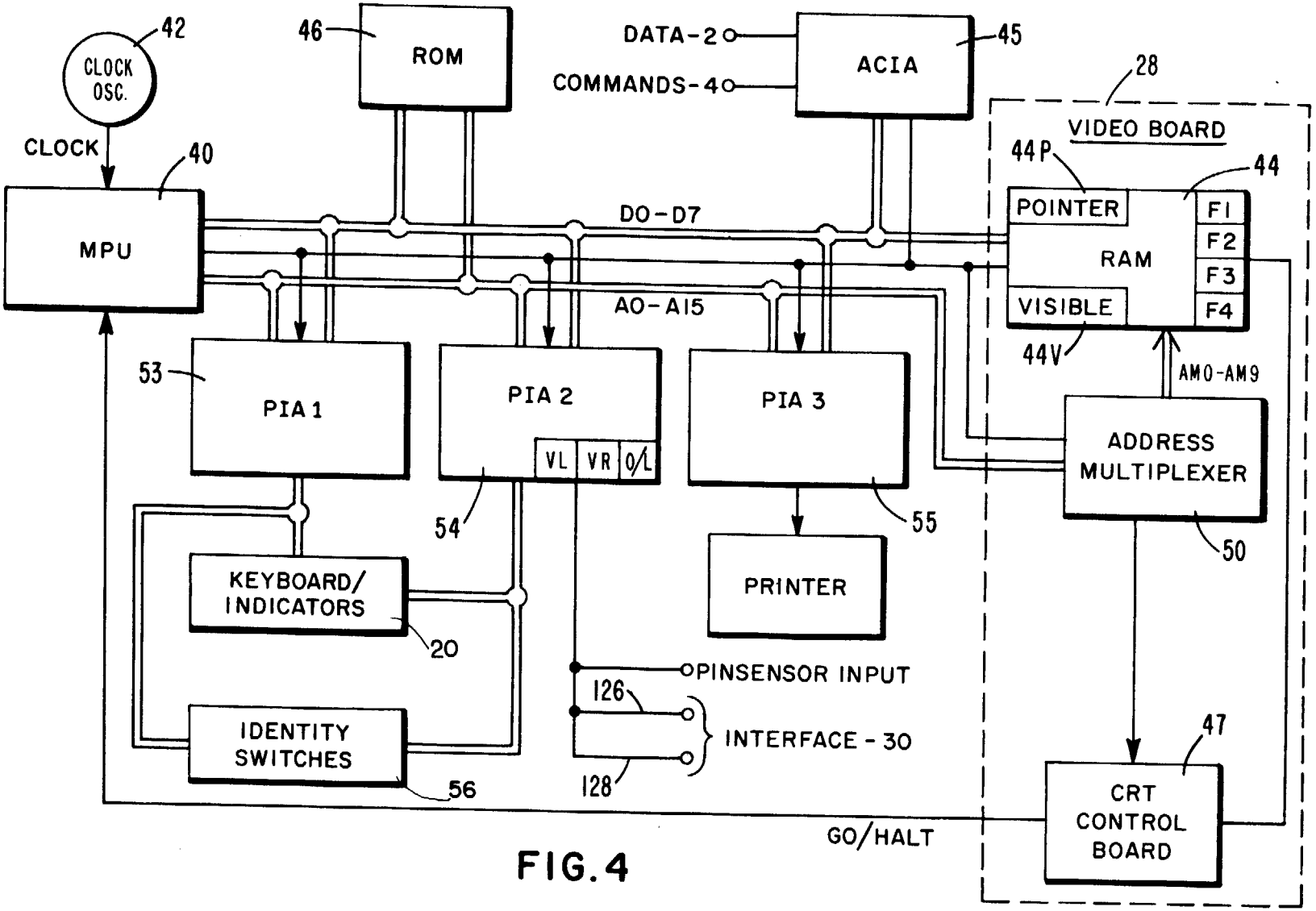
FIG. 4 is a block diagram of the significant elements of the microprocessor control board and video display board of FIG. 3.

FIG. 4 shows in block diagram form the cooperative relationship of the essential elements of the microprocessor board 22 and video board 28 located in the manager's console 1 and each lane pair score console 10, 12, 14. Each console includes a microprocessor 40 which is a Motorola MC6800 whose timing is controlled by a clock ocillator 42 connected through suitable pulse shaping networks to the microprocessor. Data is transmitted to and from this processor through ports connected to a data bus D0–D7. The addresses of the devices which are to receive the data or from which data is to originate, are generated through the "A" ports of the microprocessor, which ports are connected to an address bus A0–A15. A read/write signal on a CONTROL line controls whether the devices are to receive or send data. And the enable strobe on a control line indicates when the signal levels on address lines, data lines, and read/write lines are stable, can be interpreted by the devices attached to these lines, and therefore are to be executed by these devices.

The data to be processed by the microprocessor 40 is stored in the random access memory RAM 4 and is transferred over lines D0–D7.

The same data transfer lines D0–D7 also carry the incoming command words in 8-bit long bytes from the asynchronous communication interface adapter ACIA 45. The ACIA device 45 is a Motorola MC6850 receiving inputs in serial form from bus 2 over input port B which is located on the interface board 30. The input information is transferred on to the processor unit in 8-bit parallel form. Output information is transferred from the microprocessor to the ACIA, in 8-bit parallel form, and converted to a serial format for transfer over the outgoing bus 2. At the lane score processors, input information comprises command words received over bus 4, and output information comprises data words sent out over bus 2. The bus connections are reversed in the manager's console; bus 2, carrying data words, is connected to the input of the ACIA device 45; bus 4, carrying command words, being connected to the output of the ACIA device 45.

The controlling program for each console microprocessor 40 is stored in the read only memory ROM 46 addressed over address lines A0–15; the commands are supplied to the microprocessor 40 over data lines D0–D7. The program for the lane score processor computes for display and printing purposes, individual and team game score data on a frame-by-frame basis in accordance with principles well known in the bowling art. For a more complete description, see the Kaenel application incorporated herein by reference.

The program for the manager's console 1 controls the bus communication between the manager's console 1 and each lane score console 10, 12, 14. The functional behavior of any addressed lane score console 10, 12, 14 can also be controlled from the manager's console. The functions will be discussed below, especially with respect to the control of the video display at the individual lane score consoles and the manager's console.

Each console manager 1 or lane scorer 10, 12, 14 has a random access memory 44, located on the video display board 28. It is accessed via an address multiplexer 50 and transmits its data back to the microprocessor unit 40 over lines D0–D8. The CRT control board 47 (to be explained in detail in describing FIG. 5) which is the major element of the video display board 28, accesses the random access memory 44 via the address multiplexer 50 to derive the data to be displayed on the left and right lane CRT monitors 24L and 24R (FIG. 5) which constantly display left and right lane game score information. The CRT control board 47 is connected by a GO/HALT line to the microprocessor to interrupt the operation of the microprocessor at regular intervals when the random access memory 44 is being accessed by the video board to transfer a line of data for display purposes. This halt function is necessary to avoid contention problems between the video board 28 and the microprocessor 40.

Data is routed to and from peripheral devices through peripheral interface adapters (PIA) 53, 54, 55.

These adapters 53, 54, 55 are connected to the address bus A0–A15 and to the data bus D0–D7 to communicate with MPU 40. Each PIA 53, 54, 55 is a Motorola MC6820 which receives signals on the address bus from the microprocessor MPU 40 and includes a plurality of output lines for transmitting signals to the address peripheral units. The PIA includes a plurality of registers capable of holding a PIA output line high or low for an extended period. Thus, in response to a brief input signal, an output signal can be established to control a desired function as, for example, lighting an indicator light at the keyboard and display panel 20.

PIA 3, 55 is dedicated to the thermal printer to print the game score information as fully disclosed in the referenced Kaenel application.

PIA 2, 54 is used for a multiplicity of different purposes. For one, it drives the "open/league" indicator lights (i.e., CA2 terminal) and stores in a register the "open/league" flag which is used by the program to control various sequences. Also, the communications channel with the pinsensor terminates at this PIA 54. Furthermore, mode selection signals are tested by it (i.e., automatic/manual modes, printer enabled signal, printer fail). One port of PIA 2, 54 is used to control a status indicator light at indicator panel 20 which is made to flash if the MagicScore unit has not been used for three minutes; it remains on when the game reaches the ninth frame.

One port is used to energize identity switches 56 by which each MagicScore unit is given a distinct address; the program can interrogate these switches to determine if a command code at the manager's console is addressed to it. The results of such an interrogation operation are read by the ports of PIA 2, 53. One port of PIA 2, 54 is used to control the interface 30 (FIG. 3) by which the video signal of the MagicScore display monitor can be applied to the manager's console video bus 8.

Eight ports of PIA 1, 53 in combination with eight ports of PIA 2, 54 are used to scan a matrix of keyboard crosspoint contacts on keyboard 20. These ports are usually set to the high-impedance input mode. Sequentially, one at a time, these ports are temporarily switched to the low-impedance output mode during the scan sequence and a low signal level is applied to them when they are in this mode. Contact closures of the keyboard are detected by the ports of PIA 2, 53.

The use of PIA devices 53, 54, 55 and ACIA device 45 in combination with a microprocessor 44 is fully disclosed in the manual "M6800 Microprocessor Application Manual", copyright Motorola Inc., 1975, available from Motorola Semiconductor Products Inc.

The specific commands to be addressed to the PIA's 53, 54, 55 in the operation of this inventiion will be discussed in detail below.

Figure 5A:
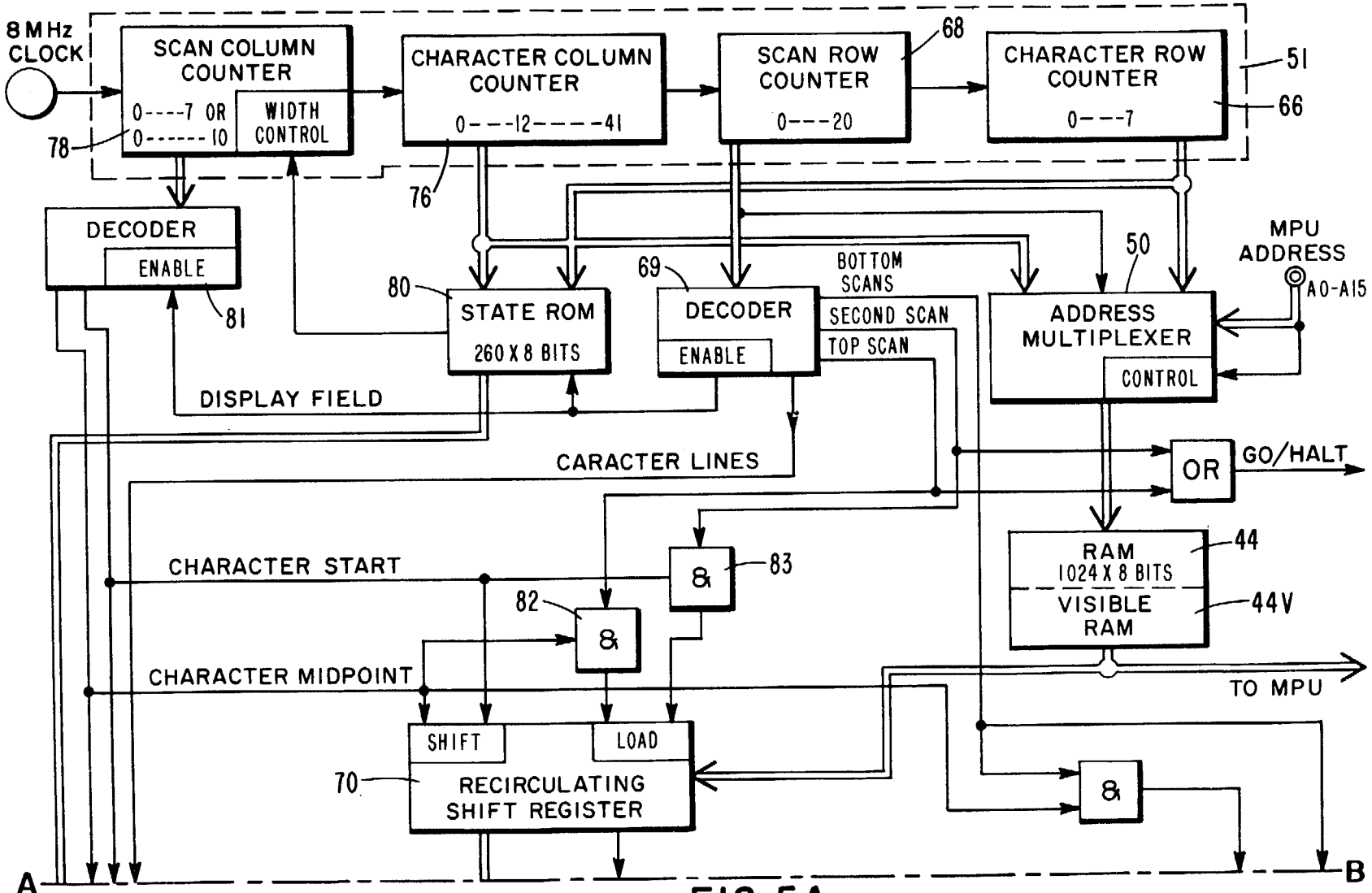
FIG. 5 is a block diagram of the video display control board of FIG. 3.
Figure 5B:
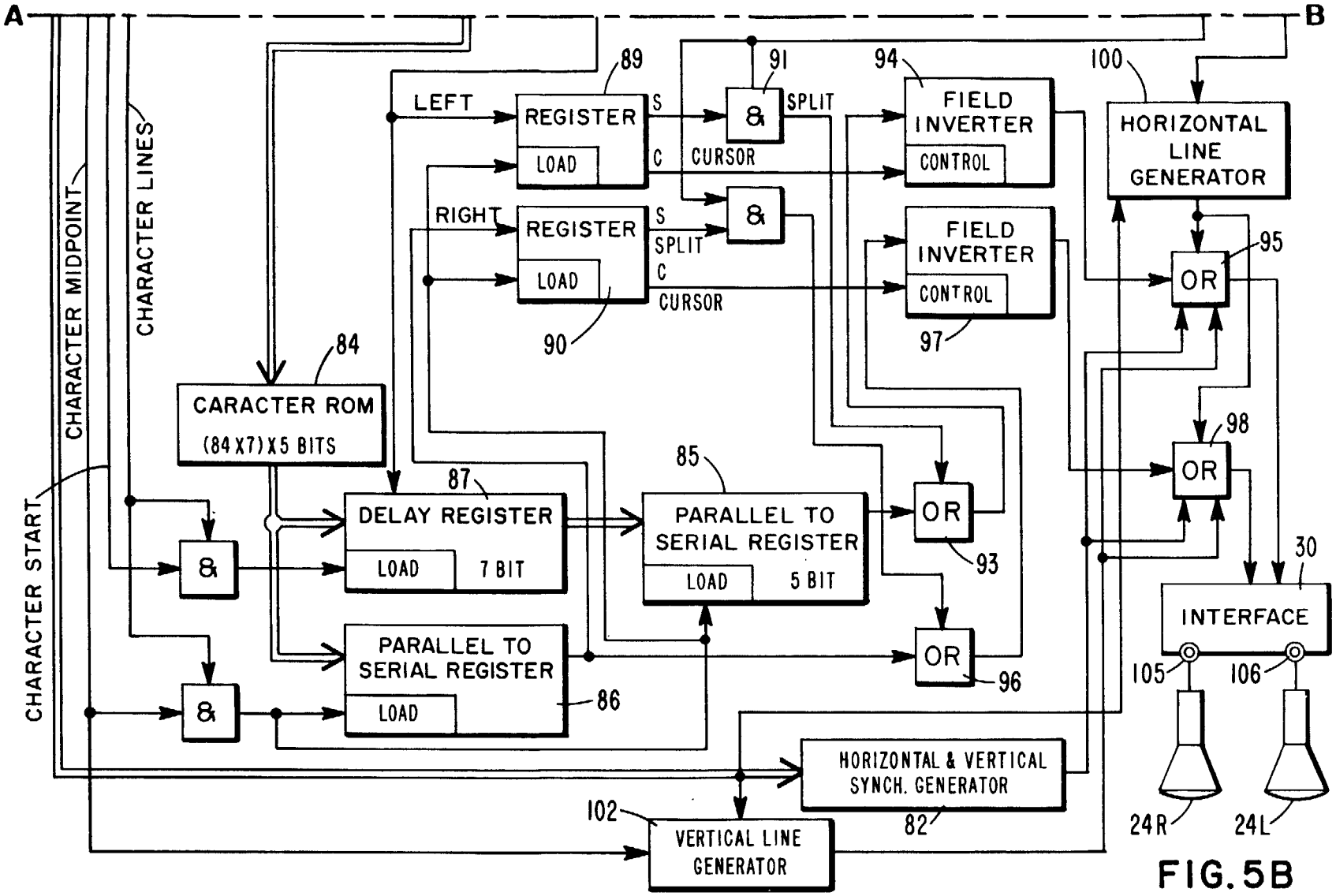

The CRT control board 47 of video display board 28 is shown in FIG. 5, which comprises two portions 5A, 5B; FIG. 5A should be placed above FIG. 5B. By means of this board, a selected area of the random access memory 44 identified as VISIBLE RAM 44V which stores the identification of each player, each player's game, frame by frame, and total score information is repetitively accessed. All the information stored in area 44V is displayed on the monitors 24.

The random access memory 44 is addressed through an address multiplexer 50. The same random access memory 44 stores the data to be operated on by the microprocessor 40, which also uses multiplexer 50 for addressing. The CRT control board 47 includes means for addressing the random access memory 44 without interrupting the microprocessor 44 comprising clock controlled counter 51. In order to avoid a contention problem with both the microprocessor 40 and the CRT control board 47 simultaneously attempting to access the random access memory 44 through the same address multiplexer 50, a GO/HALT line is provided from a counter controlled decoder 69 to the microprocessor 44 which interrupts the microprocessor 40 on a regular schedule (8 MHZ rate) when the random access memory is being accessed by the CRT control display board 47.

The operation of the CRT control board shall be briefly described below; its construction is simplified by the fact that the CRT display has only two levels, black and white. This consideration also simplifies the design of the important feature of this invention, i.e., the interface (30, FIG. 7) by which the output signals defining the CRT display normally appearing on the left and right monitor 24L and 24R are selectively decoupled from these monitors and applied instead to the video out bus 8 (FIG. 8) via the video interface of FIG. 7.

The CRT control board 47 includes a clock controlled counter 51 having four separate counters therein for accessing RAM 44 and locating the data characters stored therein defining each player's game and frame score informatiion on the monitor 24. It can be seen from FIG. 1 illustrating the display of a typical CRT monitor 24 at the manager's console 1, that a complete display for one lane includes eight rows of characters. A top or heading row includes the name of the team and the number of each frame being bowled as well as total and handicap headings. The next six rows are for the display of the game scoring information of the six possible bowlers on a lane. The eighth row names the player who is presently bowling on the displayed lane, the number of games and frames already bowled on the lane, and the individual and team running scores and totals. At a lane score console the displays for the left and right lanes appear on separate left and right monitors 24L and 24R. The character data for the two displays is stored in alternating positions in RAM 44. Thus, by alternately shifting out characters to separate registers, as discussed below, both left and right displays are produced by a single control board 47.

The eight rows of a display are counted by the character row counter 66. As the character row counter 66 counts through the eight character rows, row by row, signals are applied thereby to the address multiplexer 50 which accesses the random access memory 44.

Thus, as each row is completely displayed the eight rows of a display are counted by the character row counter 66. As the character row counter 66 counts through the eight character rows, row by row, signals are applied thereby to the address multiplexer 50 which accesses the random access memory 44.

Thus, as each row is completely displayed, the next row of characters in RAM 44 is addressed for transfer. Each of the eight rows of a CRT display is broken up into twenty horizontal scans. Data transfer from the random access memory 44 to the recirculating shift register 70 occurs during the top and second scan of each character row. These scans are counted by the scan row counter 68. The output of the scan row counter 68 is applied to a decoder 69 having a repetitive output which develops the signals shown to transfer each character display row from the random access memory 44 to a recirculating shift register 70.

It can be seen that the outputs of the decoder 69 during the top and second scans are applied to an OR gate 72 to apply a signal to the GO/HALT line to the microprocessor 40 to halt its operation. For the duration of this signal, the character row counter counts an address the random access memory 44 through multiplexer 50, and the microprocessor 44 cannot interfere. The same top scan and second signals are applied through AND gates 74 and 76 to the load control input of the recirculating shift register 70, causing a row of characters to be inserted in the shift register from RAM 44.

Each row of game score information on the screen includes space for 41 characters. These characters are counted by the character column counter 76. The width of each character varies from 7 to 10 counts, depending on its location on the display, i.e., a character adjacent a vertical line had a higher associated counted width, to allow space for the line. The count is provided by the scan column counter 78 and is changed from 7 to 10 by a signal from the state ROM 80 which stores the over format of each line of characters. Format signals are transmitted on the output line from the column decoder 81 to the horizontal and vertical sync generator 82 to provide the necessary sync signals as the beam scans across the screen. The associated state ROM 80 is in effect a redundant decoder in the sense that different addresses have the same output so that the format assigned to each character frame and each row can be efficiently stored.

The decoder 81, connected to the output of the scan column counter 78, provides two signals, CHARACTER MIDPOINT and CHARACTER START to AND gates 82, 83, which receive as the other input thereof the top scan and second scan signals from decoder 69. These gates 82, 83 provide two successive load signals and two successive shift signals during the top and second scans of each line of characters; this arrangement is necessary because the character data for each line on the left and right monitors 24L, 24R is interlaced on a character-by-character basis in the random access memory 44. That is, the first character for the left-hand monitor is followed by the first character of the first line on the right-hand monitor and so on. Therefore, the characters for the left-hand monitor 24L are first shifted out of the random access memory 44 into the recirculating shift register 70 and then the characters for the right-hand monitor 24R.

Each row of characters is converted sequentially through a character dot ROM 84 into a sequence of display dots during a beam scan. The binary information necessary to display each character is provided by the character read only memory 84 as each character is read out of the shift register 70. A different line of dots is produced for the same row of characters stored in each register 85, 86, depending on the scan line in a displayed row. Thus, the character ROM 84 is also a decoder for outputting the binary beam modulating signals necessary to define each character on the screen.

The beam modulating signals from this read only memory 84, if for the left-hand screen, 24L are stored in a 7-bit delay register 87. The data representing the following character in the recirculating shift register 70, which is to appear on the right-hand monitor 24R, are loaded directly into a parallel to serial register 86. As this register 86 is loaded, the delay register 84 shifts its storage bits to the left-hand monitors parallel to serial register 85. Use of delay register 84 allows the display on both the left- and right-hand monitors to be controlled using a single sync generator 82.

In each 8-bit character word, two bits have special significance. A single significant bit determines whether the character to be displayed shall be a cursored character. If so, the character appears on the monitor on an inverted field, i.e., as a black character on a white background rather than a white character on a black background. A second significant bit is dedicated to indicating that a split has occurred when the indicated pin fall was achieved. If so, a short vertical line is displayed under the middle of the character. Each of these bits enable lines loading into register 89 and 90. The output of the register 89 when a split bit is detected is combined via an AND gate 91 with the character midpoint signal and bottom scan line signals received from AND gate 92 to properly combine the split indicating vertical dot line; and these character dot signals are combined with the character dot output of register 85 at OR gate 93.

If the character is to be cursored, then the output on the C line of register 89 activates the CONTROL input inverter 94, and the character dot output from register 85 via OR gate 93 is inverted by field inverter 94. The output of this field inverter then is combined at OR gate 95 with sync signals from generator 82, and transmitted via interface 30 to port 106 and monitor 24L. The right monitor's video data signals are transferred from register 86 through OR gate 96 (which adds the split display signals) to field inverter 97 where the display field is inverted by the presence of a cursor signal C from register 90. The output of inverter 97 is transferred through a multiple input OR gate 98 to interface 30, port 105 and monitor 24L.

The other inputs to multiple-input OR gates 95, 98 are signals from the horizontal and vertical line generators 100, 102 which draw the background grid on the screen. The verticcal line generators 100 and 102 are controlled directly from the decoder 82 based on signals received from the state read only memory 80 and the count from scan column counter 78.

All of this disclosure is as a background to demonstrate how the serial, binary signals are developed to place information stored in a lane score console random memory 44 on the left- and right-hand monitors 24L and 24R. The same CRT control board is located at the manager's console 1; the CRT monitor at console 1 is connected to one video output port 105 or 106, with the other port left in air. Since the video signals to each video port comprise only a sequence of binary information, an interface 30 has been designed to transmit the video from any lane monitor 24L or 24R to the manager's console 24. This invention is particularly concerned with means for taking the display off either monitor and transferring it over VIDEO OUT bus 8 to the display of the manager's console 1. Alternatively, on appropriate command, the manager's console is able to put its own display directly on the face of monitor 24L and 24R, replacing whatever game score display normally appears thereon under the control of CRT control board 47. The means by which these functions are accomplished is included in the interface shown in detail in FIG. 6.

Figure 6:
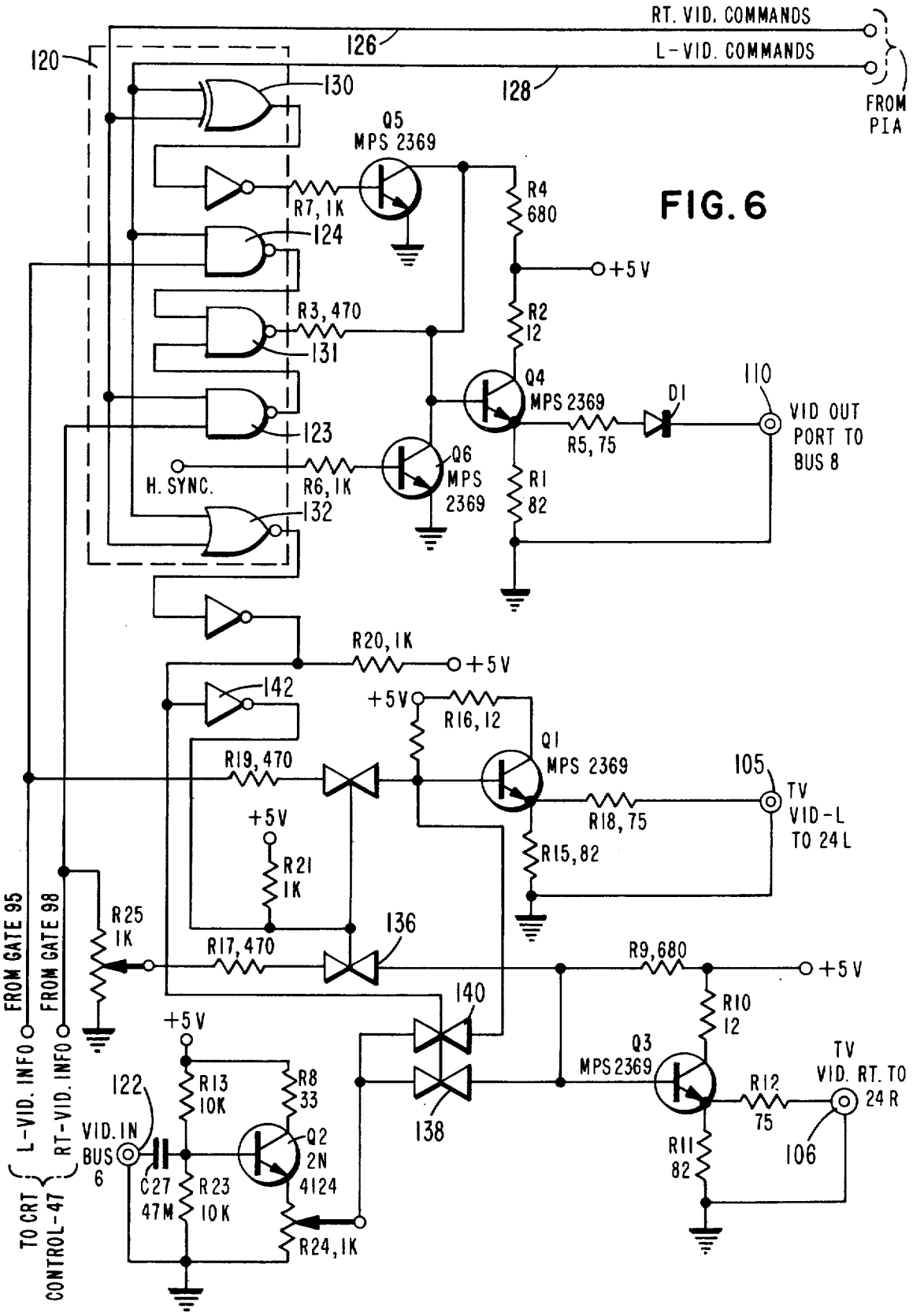
FIG. 6 is a detailed schematic diagram of a portion of the interface between video input/output parts of each processor.

FIG. 6 shows the video switching circuit interface board 30 in detail including the connections to buses 6, 8. The other buses, the command cable 4 and data cable 2, are directly connected to the ACIA device 45 shown in FIG. 4 for transmitting commands to the microprocessor and receiving data words back from the microprocessor. Cables 6 and 8 are connected to ports shown on the interface board of FIG. 7.

The discussion below describes the function of the interface board at a lane pair score processor 10, 12, 14. The bus connections would simply be reversed at the manager's console 1.

The VIDEO OUT cable 8 which transmits the information from a lane monitor at an addressed console back to the manager's console 1 (FIG. 1) for display on that console's single monitor (FIG. 1) is connected to a VIDEO OUT PORT 110. This VIDEO OUT PORT 110 receives either the left or right video information as determined by the video selection gating system 120 to be described in detail below. The gates of the video selection means 120 are enabled by commands transmitted from the manager's console 1 (FIG. 1) to the lane score microprocessor 22 of the addressed land score console. The switching does not affect the continued game score display on the local monitor.

Alternatively, where the manager's console wishes to display information on the lane score consoles left and right video monitors 24L, 24R as, for example, advertising information, this information is transmitted directly to the VIDEO IN PORT 122 over VIDEO IN bus 6. The locally generated game score means 120 which selectively transmits information appearing on the left and right monitors 24L, 24R to the VIDEO OUT PORT 110 also includes gates for cutting off the video normally received by the left and right monitors 24L, 24R from CRT control board 47 of video board 28, so that the monitors 24L, 24R display video from the manager's console 1 arriving on bus 6 at port 122 in place of the video locally generated. These gates are also responsive to commands from the manager's console. The means for transmitting these commands is disclosed in detail below.

As shown in FIG. 6, the left video information and right video information arriving at interface 30 from gates 95 and 98 is normally applied to driver transistors $Q_1$ and $Q_3$ and thereby to ports 105, 106 for display by monitors 24L, 24R.

The video selection means 120 functions as follows. When the manager's console orders video information from one of the two video monitors 24L, 24R at a lane score console transmitted back to the manager's console monitor 24, a command is transmitted (as shall be described in detail below) to the lane scorer's microprocessor 40. This microprocessor addresses a control register in the PIA2, 54, and sets a bit therein, establishing a listing signal on the appropriate command lines 126, 128. For example, if a signal appears on command line 126, ordering transmission of the right video normally on monitor 24R, back to the manager's console, then the AND gate 123 is enabled. This gate 123 is now going to pass the right video information currently being displayed on the right video monitor 24R through the gate 131 and via the driver transistor $Q_4$ to the video output port 110 and out over video output bus 8 without interfering with the display on monitor 24R.

Alternatively, if the left video is desired at the manager's console monitor 24, the appropriate command to MPU 44 causes it to set a bit in the control register in the PIA 3, 54 to establish a signal on the left video command line 128 which is applied to gate 124. Thus, gate 124 has the left video information applied to the other input thereof. This video information will now be transmitted via the gate 131 to driver transistor $Q_4$ and out the video port 110. In either case, appropriate horizontal sync signals are added to the outgoing signal via transistor $Q_6$. The outgoing video via gate 131 is a two-level signal, i.e., +1 and/or 0. The added sync signal is at a −1 level, and must therefore be added beyond the last logic gate. Gate 130 is an exclusive OR gate which pulls the VIDEO OUT port 110 to ground in the absence of a command or in the presence of both commands on lines 126, 128, to prevent spurious transmission, especially of the H SYNC signal.

Or gate 132 is provided to implement a third alternative, i.e., that the manager's console commands the display on monitors 24L, 24R of information transmitted from the manager's console on bus 6. To carry out this function, it is not only necessary to apply the information from bus 6 via port 122 to left and right video ports 105, 106; it is also necessary *cut-off* cut-off the normal video information from gates 95 and 98. This is done by transmitting commands from the manager's console to the microprocessor 44 to set register bits requiring transmission of both the left and right video. On transmission of an appropriate command to the lane score units to display the information on bus 6 on the left and right monitors 24L, 24R, the microprocessor addresses both the registers in the PIA 54 to set bits establishing a signal on both command lines 126 and 128. This results in command signals being applied to the OR gate 132 and exclusive OR gate 130.

The exclusive OR gate has a zero output just as it does on *no* command signal. Thus, VIDEO OUT port 110 is held at ground by transistor $Q_5$, and no monitor information is sent out port 110 on bus 8.

It is only in the presence of a signal on both command lines 126, 128 that the output of OR gate 132 changes state. In this instance, when both commands are present, the output of OR gate 132 applied via inverter 142 to multiplexer gates 134, 136, closes both gates, cutting off the normal video from gates 95, 98 to the left and right monitors. The result is that no further information can be transmitted to the left and right video ports from the local CRT control board 47 (FIG. 3). Simultaneoulsy, multiplexer gates 138, 140 are opened by the signal from gate 132; thus, the signal received over bus 6 at port 122 and amplified by transistor $Q_2$ is applied to monitor amplifiers $Q_1$ and $Q_3$ and appears at ports 105, 106 on monitors 24L, 24R.

The description above applies to the operation of the lane score processors. At the manager's console, the same CRT control board 47 (FIG. 5) and video interface 30 (FIG. 6) are used. The single monitor 24 is connected to either the left or right port 105 or 106. However, bus 8 is now connected to port 122; and bus 6 which carries video to the lane score processors 10, 12, 14 is connected to port 110. Alternatively, bus 6 at the manager's console end may be connected directly to a TV camera and video amplifier, the TV camera being normally directed at an advertising display. In this alternative the video amplifier could include an AND gate having an enabling line connected to a PIA port; the gate would be opened when the register connected to the PIA port has a bit set by the manager's console microprocessor.

As to the commands, establishing a signal to both command lines 126, 128 at the manager's console blanks out the local display and puts the display from the selected lane score processor on the monitor 24.

Communication of commands from the manager's console 1, FIG. 2 to each lane score processing units 10, 12, 14 is in the standard asynchronous code format. Four code types are defined by using identifying bits in the last significant bit positions. The microprocessors immediately recognize these bits to identify the code type being received. This enables the manager's console to communicate effectively with any one or more of the lane score processing units. First, a unit address code is transmitted on the command bus 4 which is identified by the two least significant bits being 01. If the manager's console is addressing all lane score units, the 6 most significant bits are all ones. If a command is being sent that instructs the scorers to disconnect all video signals from the video cable 6, then the six-bit address consists of all ones except for the least significant bit.

A lane score processing unit 10, 12, 14 recognizes that it is being addressed by accepting and storing each address code received on the command bus. It first tests to determine if either of the 6 address bits consist of all ones or of all ones except the least significant bit. In either case, a flag bit is stored in a predetermined register in the random access memory causing the MPU 40 to recognize that it must process the next command on bus 4.

In the case where an individual lane score processor 10, 12, 14 is being addressed. A unit recognizes its own individual address by comparing the 6-bit address code to an address which is established manually on an array of six microswitches 140 located on the MPU board 40. These microswitches 140 are connected between ports on the PIAs 54, 53; the ports are addressed in turn and a comparison routine is carred out by MPU 44 to determine if the address code received does in fact match with the address code established on the microswitches 140. If there is a match, then a flag is set in a register in random access memory 44. The addressed score processing unit will then accept, store and operatee on the basis of the succeeding command words received in its ACIA 45 over the command bus 4 from the manager's console 1.

These codes consist of (1) a memory pointer code which will identify the register in random access memory 44 which stores the data on which the lane score processing unit is to operate or the PIA register to be addressed. Next (2) is transmitted a control code which will tell the microprocessor exactly what operation is to be performed, e.g., set or reset a bit. Finally (3) is sent a data code which will identify by the significant bits included in the code which bit locations in the register identified by the memory pointer code are to be operated on. Each of the command words, be it a memory pointer code, a unit address code, a control code, or a data code is transmitted in a format of 8 bits equal to one byte, to be compatible with the structure of the disclosed system which operates on 8 bit format codes.

The type of code being transmitted is identified by the state of bits in the least significant bit positions of the 8-bit byte. Thus, for example, a total of 12 bits are necessary to identify each and every one of the available memory locations at the lane score processing unit. These are provided by transmitting the memory code in two successive bytes. A byte wherein the two least significant bits are 00 designates that the other six bits comprise the low order 6 bits of the 16 bit memory pointer. The byte wherein the two least significant bits are 10 includes bit 7–11 and bit 13 of the memory pointer. The other bits of the pointer are automatically considered to be 0.

As pointed out above, the unit address code is identified by the two least significant bits being 01. The other six bits provide the address.

The control code is identified by the three least significant bits being 111. The data code must include eight significant bits of information. Therefore, it is transmitted in two successive bytes. Each data code byte is identified by the three least significant bits being 011. Where the fourth least significant bit is 0, then that byte includes the four bits representing the lower order half byte of data. Where the fourth least significant bit is 1, the other four bits of the data code represent the high order half byte of data.

Each lane score processing unit 10, 12, 14 under control of its microprocessor 40 receives each byte at the input port of the ACIA unit 45 where it is converted to an 8-bit parallel format and transmitted in that form to the microprocessor 44 which acts on the information as follows. Upon detecting that a memory pointer code or a portion of the memory pointer code has been received, the significant bit information which makes up the memory pointer code is deposited in a pre-designated pointer register 44P in the random access memory 44. Then in the course of the subroutine commanded by the control code, this pointer register 44P will be read to determine the register to be accessed by the processor 40 to carry out the commanded operation. The control code is next received by the MPU 40. The microprocessor 40 sets what are termed control flags according to the command contained in the control code. These flags are bits set in significant bit locations in predesignated registers F1–F4 in random access memory 44 or PIA 2, 54. These designated locations, flag registers F1–F4, each have 8 bit positions. Therefore 32 flag bit positions are available each of which may be selectively set and tested by different subroutines. For an example of how such bit positions may be arrayed, see lines 24–30 of page 1 of the program in Appendix A.

As a part of the normal processing sequence of the lane control scoring unit, the microprocessor 40 interrupts what it is doing on a regular schedule, e.g., every eight milliseconds, and tests each of these flag register locations. When a flag is detected, the program automatically branches to the subroutine commanded by that flag. Therefore, the control code may set a flag which designates that the scorer is to receive a data code and use it to modify the bits of the memory location addressed by the content of the pointer register. This may occur for example where the manager's console commands the page mode, i.e., a paging message is to be displayed on the top line of a monitor's display for a given lane. For example, the message might be for the player to call a particular extension number. In order to do this, the manager's console simply transmits the control code which states that the following datawords are to be stored in the RAM 44, beginning with the register pointed out by the pointer register 44P and in the following sequence of registers. Once the page message is stored in these registers, which would be located in the "visible" portion 44V of the RAM 44, then these registers would normally be acessed and their contents displayed as a part of the normal operation of the CRT control display board 47.

Alternatively, the command flag may indicate that the microprocessor for the lane score unit is to transmit data from the location specified by the pointer register.

For example, the pointer register 44P may designate a register which contains game score data for a particular lane. The command may order that bit of data and all succeeding bits of game score data for the lane sent back to the manager's console memory 44, so that the manager's console 1 can print the score record for that lane. Since the manager's console microprocessor is fully compatible with the lane score processor consoles, being made up of exactly the same components and having only a modified controlling program, no modification of the data transmitted back to the manager's console is necessary. It is simply stored in a designated location in the random access memory which is normally accessed by the printer in the course of its print routine.

Alternatively, a control flag may be set which indicates that the bits defined by the ones in the data word are to be set. For example, this is a means of setting a flag in register VR or VL in PIA 2, 54 connected to lines 126 and 128, respectively, commanding interface 30 to transfer the selected video display over bus 8 to the manager's console 1. The command may require the resetting of a bit in a particular register location. This would be the case for example where the register VR or VL which in the PIA 54 is used to command video transfer is being reset to end video transfer from the lane monitor 24R or 24L back to the manager's console monitor. Finally, the manager may be testing the bit pattern of a location as for example addressing all the MagicScore score units to test if any have their screens blanked out, and asking that any score unit which has that flag set which causes its screen to be blanked transmit its address back to the manager's console. Thus, the processing at any one or more lane score processing units can be affected and interrupted during the otherwise normal procedures, from the manager's console which thereby exercises full overall control over the scoring functions carried out at each lane score processing units.

In operation, a manager's console function is executed by activating the corresponding key which causes a respective software subroutine to be entered. These keys 200 of the manager's console are shown in FIG. 1; the functions which they initiate are shown in FIG. 7. It can be seen that eleven of the functions are initated by keys so labeled.

The twelfth key is an execute key which is included to allow the manager time to reconsider the executive decision he has made and push the reset button instead of the execute button. For example, to display at the manager's console the display at lane 2, one would push 2 - DISPLAY - EXECUTE. To end the display, one pushes 2 - RESET - DISPLAY - EXECUTE. Once the subroutine addressed by the keyboard is entered, it transmits a series of codes on the command cable, beginning with the address code that selects the desired lane score unit or units according to the unit number (lane 2) that was first entered from the keyboard and is being displayed on the CRT display panel. Next is transmitted the memory pointer code which designates the memory location of the scorer wherein activity is to take place. (In this case a PIA register VR or VL.) This is followed by the control code which designates the type of activity that the MagicScore console is to carry out (set a bit in that register). This is followed by the data code which specifies the bits involved in the activity. In almost all cases, a data code is necessary. For example, to command a score processor to transmit its video data back to the manager's console, one particular bit in the designated register VR or VL in the PIA 54 must be set. Therefore, after the pointer register carries the address of that video display transfer command register in the PIA, the command carries a code requiring designated bit in that register to be set. Finally, the data code must carry a one in the least significant bit location of the actual data word. This indicates that it is only that bit which is to be set, thereby establishing a command signal on the line 126 or 128 connected to the addressed register.

In the bowling system described herein, many functions are initiated in the scorers by setting particular flags which are interpreted by the scorer's software as they would interpret entries from their own keyboard, for example, clear or print. Others involve requiring the lane score processing unit to read the status of certain flags, that is certain bits in the register selectively addressed by the pointer register (for example, 10th frame light on, open mode, list units inhibit mode). Still others involve storing particular data in selected locations (for example storing a paging message, storing a lane number display). Finally, some functions require the transmission of data from a particular lane back to the manager's console. For example, the manager's console print function is accomplished by transmitting the contents of the locations in random access memory which store a lane's game score data from a lane score processor into the manager's console random access memory. This is accomplished by transmitting the pointer register at the addressed lane scorer the first data location for a given lane for frame 1 of player 1 on a particular lane, and ordering the transmit function for that particular register; and then transmitting in the command code the included order to increment the number stored in the pointer register so that all the registers storing the game score data for an entire lane are sequentially addressed from the pointer register, and each register's contents in turn are transmitted back to the manager's console for storing in corresponding locations in the manager console's random access memory. The manager's console score program includes a printer subroutine for driving its own printer including a routine for calculating the score, and for transmitting it to the printer.

Thus, by transmitting the proper orders from the manager's console to the lane score processing unit, the manager's console is able to modify or interrogate any memory location of a lane score console unit. The manager's console 1 is able to gain control and initiate execution sequences followed by an addressed lane scorer 10, 12, 14 and thus significantly modify the functional sequences followed by the lane scorer. The use of standard components and subassemblies in both the manager's console and at the lane score processing units allows for simplified transmission of data over the buses 2, 4, 6, 8 between the manager's console and the scorer units, without the need to significantly modify the program sequence followed at the lane score processing unit 10, 12, 14 and without the need to otherwise structurally modify the lane score processing unit except to provide the necessary interface 30 between the bus connections which has been disclosed above. No complex data conversion techniques are necessary to provide the communication between the manager's console 1 and the lane score processing units 10, 12, 14 since both follow substantially the same execution sequences and are written using the same instruction set. Thus, a further important advantage resides in the simplified stocking of spare parts and facilitation of maintenance of the manager's console and the lane score processing units. The only difference between the manager's console 1 and the lane score processing unit 10, 12, 14 is a modification of the read only memory ROM 46 storing the program which controls the operation of the microprocessor 44 at the manager's console 1 to incorporate the necessary transmitting command. The individual lane score processing units 10, 12, 14 include as a normal part thereof an interrupt sequence for checking certain registers designated herein as flag registers to see if a bit has been set in such a register, or to set or reset a bit in a register in RAM 44 addressed by the contents of pointer register 44V. Such a bit serves a jump command to an existing subroutine in accordance with well known programming principles. Such programming principles as are specific to the disclosed system are disclosed in "M6800 Microprocessor Programming Manual"; copyright Motorola Inc., 1975 and published by Motorola Semiconductor Products In. and incorporated herein by reference.

The operator's keyboard which is used to initiate control functions over the lane score processors is shown in FIG. 1 as it appears at the manager's console station. It includes 12 keys labeled to indicate the specific functions they initiate. A standard typewriter keyboard is provided for entering data and information directly into the manager's console memory 44. Some of the alphabetic keys may also be used to initiate functions as shown in the left-hand column of FIG. 7. The numeric keys are used to deisgnate particular lanes. The normal sequence for causing a function to be performed is to designate a lane number, then push the desired function key, then push the execute button. For example, the manager may wish to put lanes 1–10 in the league mode. He would push key 1, the THRU key on the console keyboard, and the 10 key. This would designate the lanes. He would then push the function key LEAGUE. He would then push the EXECUTE key causing the manager's console to address in succession each of lanes 1–10 and transmit to them an address pointer which points at the register which normally stores an open/league flag; a command to set the flag in the addressed PIA register; and a data word having a bit in the bit position corresponding to an indication to the local score processor 10, 12, 14 that the league mode should be followed in carrying out score processing operations.

The available communication functions between the manager's console 1 and the lane score consoles 10, 12, 14 are listed in FIG. 7. The key used to initiate the function may be an alphabetic key on keyboard 200 (FIG. 1). If so, it is listed as such on the KEY column. If a dedicated command key is provided on keyboard 200, it is indicated by a dash in the KEY column. It can be seen that under the set and reset columns, some of the lines have a term such as EXECUTE which means that the function listed in the FUNCTION column is immediately carried out when the EXECUTE key is pushed. Other lines, in the set and reset columns, simply have an X. This means that the keying in of the function at the manager's console simply has the result of storing a flag in the appropriate register at the addressed score processing unit.

A function such as the function for paging messages is carried out as follows. A lane, for example lane 5, is designated. The appropriate paging message, which may be "call extension 234" is typed on the keyboard, as the keyboard has been enabled by pushing the page key on the function keyboard. The paging message is displayed in replacement of the top row of data which would otherwise appear on the screen in the locations corresponding to the locations where it will appear at the designated lane. This is accomplished simply by storing it in the appropriate locations in the visible portion of the random access memory 44. When the message is completely typed in, the EXECUTE key is pushed and the program transmits a pointer which points at the location in the visible random access memory of the addressed lane score processor corresponding to the location where the first character of the paging message is to be stored in the visible RAM 44V. The command which follows is to store the succeeding data words in the register pointed at, and that the address stored in the pointer register at the lane is to be incremented after each data word is stored until the entire paging message has been stored in the appropriate locations in the visible random access memory. As the message is stored, in the visible portion 44V of the lane scorer's random access memory 44 the message is displayed at that lane scorer on the monitor 24L or 24R. The manager's console can eliminate the paging message by the manager pushing the lane number, the RESET key, the PAGE key and the EXECUTE key which will cause a pointer register address again corresponding to the first location in random access memory now holding the paging message to be pointed at. The command now sent is to replace the paging message with the heading which normally appears in row 1 and which can be found in a dedicated stack of locations at the manager's console RAM 44. The program moves each of these stored pieces of data back into the visible random access memory, and the normal display is restored.

Finally, as shown in the LIST column of FIG. 7, most functions commanded from the manager's console, a list appears on the manager's console monitor 24 of the lanes to which the command is directed or which are currently in the state specified.

The program for controlling operations at the manager's console is included herein at Appendix A. It is in the standard programming format used for the Motorola MC6800 8-bit processor. The left-hand column is a line number for each instruction. The next listing on each line consists of the address in memory in hexidecimal code of the operation code of the next succeeding instruction. The third column includes two alphanumerics which are the hexidecimal representations of the operational code. The next column includes four alphanumerics which are the hexidecimal representation of the memory address associated with the operational code; that is, the storage location of the data to be operated on.

The next two columns are a short-hand representation of the operational code defined in hexidecimal in column 3, and the memory address of the data to be operated on defined in hexidecimal notation in column 4.

Thus, referring to the program used to transfer the display at a lane monitor 24L or 24R to the manager's console monitor 24, the DISPLAY PROCESSOR routine appears on pages 21 and 22. The instruction at line 726 transmits to the appropriate lane score processing unit the address of the lane whose display is to be shown at the manager's console. The instruction at line 746 is a reset code sent to all lane score consoles to disconnect their video output ports from the video out but 8. In the instruction at line 755, the most significant half of the address of the PIA register is sent to the pointer register of the addressed score console. Each lane score unit has a separate PIA register for the left and right side CRT displays 24L and 24R. Therefore, the least significant half of the address must tell the microprocessor at the score console exactly which PIA is associated with the video display whose display is to be transferred. Thus, instructions 776 and 770 are provided to transmit the least significant half of the address to the pointer register, designating the left or right side PIA register. At 772, the command word is transmitted; that is, to set the bit in the PIA register addressed by the pointer register. At 774, the data code is transmitted which designates exactly which bit is to be set in the addressed PIA register. The necessary information having been assembled, at 779 the subroutine is called which transmits the command words over the command bus to the addressed score console.

As disclosed above, a command to transfer both displays at a single lane score console will result in cutting off all video and displaying the video from the manager's console. Obviously, the same pair of commands to set bits in register VL, VR at the manager's console will cause the display on monitor 24 of the display of the incoming video transferred from a designated lane.

Certain routines are supplementary to the LANE DISPLAY subroutine specifically discussed. They are also included in Appendix A, and are briefly discussed below.

The listing at pages 1–4 is the registers in the random access memory where data is stored. The list on page 4 is the addresses of the registers in the peripheral interface adapters which may be selectively addressed by the microprocessor. At pages 6 and 7, is the program interrupt which occurs every 8 milliseconds for reading the control registers, decrementing the counters, and flashing lights to indicate that the manager's console is available for accepting a command. At page 8 is the subroutine for polling the keyboard. The keys of the keyboard are connected to ports of the PIA which are energized to determine if a circuit has been closed through one of the keys. If the same key remains depressed through a number of interrupts, then it is determined to have actually been closed and debounced, and the character is stored.

Page 9 discloses the keyboard polling subroutine which determines beginning at line 338 whether a numeric, alphabetic or command key has been depressed (line 338, TBLPNT).

Various branches occur, depending on whether a numeric, alphabetic or control key is depressed. Referring to page 10, if a numeric key is depressed, indicating a lane selection, then this lane number is displayed (line 345) on monitor 24. If an alphabet key is depressed to input information, this is also displayed on the monitor 24 (line 347). If a control key is depressed at address 20E9, a control flag is set, followed by a jump to the subroutine on page 19. Pages 19 and 20 comprise a subroutine for determining what code has been commanded by the command key which has been depressed; this is followed by branches to the pertinent subroutines to implement that code (address 2375).

Pages 17 and 18 are simply a start-up routine for resetting all the registers. Page 16 is the branch routine for the numeric keystrokes that turn on lights when the execution is completed.

Page 24 is a conversion subroutine to provide the BCDBIT which is used to address a selected lane score console unit. Pages 25 and 26 are the subroutine which comprises means for transmitting an address code (OUTXNT). This subroutine includes means for checking that an addressed unit recognizes its address (24EC) and, if not, retransmitting the code (2500). Every lane score processing unit 10, 12, 14 receives the address code and by comparison with identity switches 140, determines that it is the one being addressed. Such comparison routines are well known in the art. See e.g., the listing on page 27, addresses 2571-2577, an address comparison subroutine for checking to determine that the score console next to be addressed in a sequence is not outside the desired range.

At page 27 are provided two subroutines, step to next monitor and roll display processor, the first of which automatically steps the addresses by increments of one at two second intervals (2562) so that a range of score consoles (e.g., lanes 1-10) are successively addressed. The second is a procedure for manual incrementing by one through the listed range (258C) with each depression of the N key so that a single lane monitor's display may be maintained on the manager's console monitor for as long as desired.

Page 28 is the related subroutine for executing a function over a range. At address 25AA the first numeric is stored, and at 25BO the bottom address is zeroed. At 25B8, a flag is set to indicate to the processor that it will be working over a range. At 25C2, a display text order is issued so that the message appears on the screen to enter the other end of the range. The other end of the range is read as the first step of any control surbroutine which is entered by pusing the command key on keyboard 200. This control subroutine will take the content of the BCD register which is loaded with the bottom end of the range, and put it in the range register. The data at lines 1059-1062 is the test which must be stored so that is can be displayed when called.

AT page 30 is the block processing routine which is needed to execute the same function at each address over a range and includes as significant steps therein at address 2616 resetting the abort flag to cover the possibility that there may have been a failure to execute an instruction; at 261E adding one to the last address used, at 2627 getting the top address of the range, and at 262A and following, comparing the incremented address to the new address. If the signal has exceeded the top of the range, then at 2632 a roll flag is set to prevent further steps. At 264A, the conversion is made to provide an address capable of display to indicate on the manager's monitor 24 the lane now being addressed.

At page 31 is the standard sequence which is followed when a command is not being executed, which at address 2676 inquires if the manager's console should be in the print mode, and at 2679 successively addresses all the units 10, 12, 14 connected to the manager's console 1 to determine if someone tried to clear a lane score unit or remove a score. The timer is set (2681) to limit the time in which some unit must answer. If such an action did occur, then an interrupt is set (268F), and the unit address is displayed.

Pages 14 and 15 list instructions for the page mode which is entered by depressing a lane designation and the PAGE command key on the keyboard 200. At address 21D4, the page mode is indicated on the screen, after which the processor waits for the entry of the characters which are to comprise the page message, which is to be displayed in place of the normal top text now on the game display monitor 24. Each alphanumeric key depressed is then stored in the visible portion 44V of random access memory 44. When the message is complete, the EXECUTE button is pushed. At 21DE and following is the page processor which outputs the line of characters to the addressed lane score console unit. Pushing LANE NUMBER, PAGE, and RESET to remove the page message will enter the processor subroutine at line 1181 of page 33, which jumps to the LINE TEXT subroutine at page 35. This subroutine transmits the normal top row characters to the addressed lane found at the address is defined at lines 1169-1178.

At page 23 is a subroutine for turning off an addressed unit. At 798 a unit is addressed; at 800, 802 the data VO pointer is transmitted; at 804 or 806, the command code to set or reset, that is, to turn on or off the processor, is transmitted and the flag positions where the registers to be set are transmitted at 810 and following.

Thus, the manager's console can transmit a PAGE message selectively to any lane monitor, and remove it at will after it is responded to.

This subroutine further demonstrates the communication facility provided by the invention claimed herein between the bowling establishment manager and every lane processor.

Page 35 begins a subroutine for putting out a line of text which may be a line of text which makes up the page message or if the page message is to be removed, the subroutine for transmitting the standard top line of text which is stored at locations 26C and following as shown on page 33. This subroutine must include the standard BCDBIT transmission of the addressed lane score processing unit and at address 2724. At locations 2735 and following, the memory pointer is transmitted, telling the addressed lane console to select the memory locations in which the line of text is to be stored.

At 2727 is the instruction to the addressed lane score console to look at the inputs on the data line, and the instructions at the following addresses tell the scorer console to store the incoming data in locations suceeding the original memory pointer and incremented successively by two. To eliminate the page message and replace the normal top row of game score data shown at 202 in FIG. 1 at the lane score console 24, the manager pushes the numeric key to designate a lane number, PAGE and RESET. This causes the processor at the manager's console to enter the subroutine at 26FO of page 33 which jumps to the line text subroutine at page 35. This subroutine will transmit the normal top row characters to the addressed lane as found at the top of page 33 in locations 26CE and following.

Page 38 is a conversion routine simply for displaying the address of the addressed lane score console at the manager's console unit. The conversion is necessary to make it compatible with the codes stored in the random access memory to be read by the CRT control board to establish the display.

Page 39, the practice play mode, is entered by designating a lane or lanes, pushing the PRACTICE command key on keyboard 200, and the EXECUTE key. The command processor output subroutine at page 25 provides the address code output means. At 3055 and 305C, the most significant and least signifiant halves of the pointer byte are transmitted. The command code to either set the practice play flag (3042) or reset it ending the practice play (304E) is next transmitted, followed by the data code at address 3063. As a result, the appropriate register in the addressed lane scorer unit has a bit set in the designated data location to act as a flag to the program at the lane score console which at its next interrupt will read the flag, and enter the practice play mode. The practice play mode simply consists in turning off the input from the pin sensor at the PIA.

At pages 40-41 is the print activation processor which is entered by designating a lane on the keyboard 200 followed by pushing the command key LANE PRINT, and the EXECUTE key. The address of the designatd lane scorer is transmitted at 30B5; the register address to be transmitted to the pointer register is at 30BA; the command code which is the set mode, that is, set the print flag, is at 30A8; and the data code which designates whether the left side or right side is to be printed appears at 308A and 308E. The same subroutine is followed when the printing is to be stopped by setting the fail flag, which is addressed by a data code at address 30CF.

The subroutine at page 42, which is used to list the printers off, consists of the addresses of some simple subroutines which are addressed in sequence to accomplish the desired function which is designated by pushing the LIST key and the alphabetic key V which is the inhibit printer key. The first step is to store and display a first line of text indicating the listing function, which is found at 30E6. After this, at 30EB, the manager's console addresses the first unit and asks for appropriate word to be transmitted back. At the following adddress, the significant bit is looked at at the manager's console and tested at the following instruction to determine if it is high or low. If it is high, then the lane number is displayed on the monitor 24 and the program jumps back to 30EE to repeat the function while addressing the next lane score console.

The next function is the suspend clear routine at page 43,. which is entered by pushing the lane designating numeric keys and the S command key. The address of the lane score console unit to be communicated with is found at 312B; the pointer register information is transmitted at 3130 and 3137. The command to set the bit is found at address 3316; if it is desired to reset the bit and end the inhibit clear, that command code is found at 3155. Means for indicating the significant bit in the designated register addressed by the pointer register comprise the command at address 311D, which transmits a byte including the significant bit. The suspend remove score routine is entered by pushing the BLANK button and the COMMAND key and the EXECUTE key. The subroutine jumps into a portion of the subroutine on page 43 beginning at address 312B, the SCSCLU to transmit the address 316F; the pointer is transmitted at 3176 and 3173, and the data code is found at 3183. The result is setting a flag which will be tested by the program at the appropriate lane score console unit before score is remoed after printing at the completion of a game at the lane, and the clear routine will not be entered until this flag is removed.

The inhibit open league subroutine on page 46 is entered by designating lane, pushing command key O, and EXECUTE. The significant portions of the subroutine are indicated by SUXOLS which is a jump to a subroutine to transmit the address of the designated lane score console unit. On return to the subroutine, at address 31AO, the pointer is transmitted; the control code is transmitted at 3147; and the data code to set this bit is at 31AE. To reset this function, and eliminate the bits set in the register storage means at the lane score console, the command at 31B3 is transmitted.

The remove score subroutine is entered by designating a lane on the numeric keys, pushing the R key and the EXECUTE key. The significant portion of the program begins at the instruction designated MSPRN4 which is a jump from another subroutine which provided the address of a lane score console unit and the pointer address.

Then follows a subroutine designated MSPRN2 which checks to see if someone attempted to remove the score. Any such test procedure, like the listing procedure, comprises means for addressing the significant register in the lane score console unit and sending a command to transmit the contents of the register to a designated register at the manager's console where a bit in that register can be tested. No data code is necessary as a part of such a subroutine because the entire register contents are being transmitted back to MagicScore for the test of that significant bit. After the test of this bit, the appropriate command to be sent is found at location 31E7 and the data code at 31EC. The program, as is obvious, provides for removing the score from either the left or right side, and on page 48, for first jumping into the print routine to require a print of both sides before the remove score routine is completed. The jump to this instruction can be found at address 3215.

The clear routine at page 50 is entered by depressing the appropriate numeric key to designate a lane, the C button and the EXECUTE button. The subroutine begins by addressing the appropriate unit using a jump to a subroutine NOTPRO. A subroutine labeled MSRN4 asks that a word be sent back from the addressed unit to determine if someone has previously tried to clear; and after the register contents are sent back, a test for the presence of a flag is provided by the routine labeled MSPRN2. An instruction to reset the flags indicating that clearing was attempted is provided at address 32AE.

The subroutine for addresing the unit and asking the register contents to be sent back is found beginning at the bottom of page 50 where the BCBIT instructions select a unit; at 32EO and 32E7 the pointer location is transmitted and at 32F1, the command to transmit the data back is sent. A timer is then set at 32FB to wait for the data to come back. Then at 3320, the return register data is tested to determine if the bit had been set in the left or right side. Returning to the previous page, then the command is sent to reset the flags which had been set, and the pointer register address command code and data codes are transmitted.

The automatic sequencing control in page 53 is entered by depressing alphabet key B followed by an EXECUTE key after designation of the lane. This subroutine is entered from the keyboard scan routine and the lane processor routine where the address of the addressed lane scorer unit is developed. After transmission of the pointer register address to select a flag register, the set command is found at address number 3366 or the reset command at 3375. The specific bit in the flag register F1-F4, which in combination with this sequence of commands provides the means for inhibiting the automatic sequencing, is designated at address 336D.

The subroutine to disable a printer at a lane scorer unit (page 54) is entered by lising the lane scorer units, pushing the S button and the EXECUTE button. At 3381 the program enters a display function which displays the function which is going to be executed. The command to set the bit in the flag register is at 339C; the command to reset the bit and enable the printer is at 33AB. The significant flag bit location is found at 33A3; the address of the flag register is at 3389. The address of the lane score unit is transmitted at BCDBIT.

At page 56 is disclosed a subroutine for setting a flag to prevent a bowler from entering his name into memory. It is entered by pushing the Z button, after the lane designator, followed by the EXECUTE key. As can be seen, the lane address is transmitted at BCDBIT, and the flag register location at address 33FO. The command code is found at address 3403, and the significant bit in that flag register to inhibit either the left or right side is found at 3410 and 3414. Thus, means are provided for selectivelly inhibiting either the left or right lane side depending on which of two data codes is trasmitted to set a bit in one of two possible significant bit locations in the adddressed flag register.

The open league select routine (page 59) is entered by addressing a lane, pushing the OPEN or LEAGUE command key, and the EXECUTE key. The function carried out is to disable the open/league select key at the addressed lane scorer unit, and then set a bit from the manager's console to put the lane scorer console in the open or league mode. In this fashion, the function established at the lane cannot be overridden by a bowler at the lane. The subroutine starts at address 34A9 with a jump to the subroutine which disables open league select and includes addressing the lane scorer unit, selecting the register O/L in the PIA which disables open lague selection, at 34AE and 34B5, and setting a bit in that register. Thereafter, the program jumps back up to 347F to transmit a set code followed by 3486 which selects the bit to result in open status, or 349A which is the reset code and 34A1 which is the same data code to eliminate the bit.

The select listing mode is entered by pushing the space key on the alphanumeric keyboard which enters the list function, followed by pushing the function command key desired. The result is a list on the manager's console screen 24 of all the lane scorer console units presently operating in the designated function mode. The listing mode begins by setting a timer for a time within which the returns from the addresssed consoles must be made, and displaying the text shown at address locations 3507 et seq. that the list mode is active. This is followed by a jump to various list subroutines. The significant subroutine for this function is at pages 80 set seq. At 4070 after the text is printed, the program jumps to 40 FB which selects a lane scorer console unit and commands the transmission back of the flag register contents. Thus, the command is sent to transmit at 4100 the contents of the register, and a timer is set to wait for the return at 410E. If a bit is present, the lane number is displayed on the monitor. Then the program goes back to the function list which goes to a block processing subroutine for testing if addressing the next lane scorer unit would exceed the designated range. If so, then the routine ends. The main purpose of the list fuction routines is to test for the significant bit position in the byte sent back from the flag register, as this byte is unique to each function indicated. It can be seen that the subroutines disclosed by loading bits in significant locations in addressable flag registers can control the operation of any lane score console. Further, by reading, i.e., transfer to the manager's console of a flag register byte, and testing a significant bit location in such flag registers, the manager can monitor bowling progress throughout the establishment.

```
00187                 ****************************
00188                 * MANAGER CONSOLE SOFTWARE
00189                 * 9 JANUARY, 1977
00190                 * LEVEL #6
00191                 * COPY RIGHT AMF,INC.
00192                 * ALL RIGHTS RESERVED.
00193                 * SOFTWARE BY R.A.KAENEL WITH THE
00194                 * ASSISTSANCE FROM YUCCA INTERN.,INC.,
00195                 * PERSONNEL, INCLUDING
00196                 * W. TUTEN AND L. MCROBERTS
00197                 ****************************
00198                 *
00199                 * HARDWARE CONFIGURATION:
00200                 *       RIGHT SIDE VIDEO PORT TO REC-TEC BOARD
00201                 *       ODD ADDRESS=LEFT
00202                 *       EVEN ADDRESS=RIGHT
00203                 *
00204                 * DATAVR $01FE (1E,F8)
00205                 * DATAVS $01FF (1E,FC)
00206                 * DATAVO $02FF (2E,FC)
00207                 * SUSFLG $0154 (16,50)

00209                 * ACTIVATION OF 'CONTROL/PAGE KEY' TOGGLES MODE
00210                 * STEADY BCD NUMERAL: COMMAND SUCCESSFULLY EXECUTED
00211                 * FLASHING BCD NUMERAL: COMMAND ABORTED,ERRORS.
00212                 * FLASHING READY LIGHT: COMMAND EXECUTED,
00213                 *            EXECUTING LIST FUNCTION
00214                 * INTERRUPT LIGHT ON: CLEAR OR RS ATTEMPTED
00215                 *
00216                 * COOMAND/EXECUTE: TO EXECUTE COMMAND
00217                 * LIST/COMMAND: LISTS UNITS IN SELECTED MODE
00218                 * NOT/COMMAND/EXECUTE: RESET COMMAND
00219                 * NOT/LIST/COMMAND: LISTS UNITS NOT IN SELECTED MODE
00220                 *

00222 2000 7E 227A          JMP    COLDS
00223 2003 B6 1005 INTR     LDA A  PIA1AC    READ CONTROL REGISTER
00224 2006 2B 01            BMI    INTXB     NOT 8 MS. INTERRUPT
00225 2008 3B               RTI
00226 2009 F6 1004 INTXB    LDA B  PIA1AD    RESET INTERRUPTS

00228                 * DECREMENT TIMERS
00229 200C 7D 0049          TST    CKBRDG    TRANSMIT COUNTER
00230 200F 27 03            BEQ    INTRAA
00231 2011 7A 0049          DEC    CKBRDG
00232 2014 7D 004A INTRAA   TST    CKBRDH    RESET COUNTER
00233 2017 27 14            BEQ    INTREE
00234 2019 7A 004A          DEC    CKBRDH
00235 201C 26 0F            BNE    INTREE
00236 201E CE 0101          LDX    #$101
00237 2021 6F 00   IN2RAA   CLR    0,X
00238 2023 08               INX
00239 2024 08               INX
00240 2025 8C 0131          CPX    #$131
00241 2028 26 F7            BNE    IN2RAA
00242 202A 7F 004B          CLR    CKBRDH+1
00243 202D 7D 004C INTREE   TST    CKBRDH+2
00244 2030 27 03            BEQ    INTRBB
00245 2032 7A 004C          DEC    CKBRDH+2
00246 2035 7A 004F INTRBB   DEC    CKBRDK
00247 2038 26 0F            BNE    INTRC2
00248 203A 7A 0050          DEC    CKBRDK+1
00249 203D D6 50            LDA B  CKBRDK+1
00250 203F C5 01            BIT B  #$01
00251 2041 26 06            BNE    INTRC2
00252 2043 96 53            LDA A  CKBRDM
00253 2045 84 F7            AND A  #$F7
00254 2047 97 53            STA A  CKBRDM
00255 2049 D6 4F   INTRC2   LDA B  CKBRDK
```

```
00256 204B C5 1F          BIT B  #$1F
00257 204D 26 20          BNE    INTRA
00258 204F 96 53          LDA A  CKBRDM
00259 2051 2A 07          BPL    INTRAX
00260 2053 88 40          EOR A  #$40      FLASH READY LIGHT
00261 2055 97 53          STA A  CKBRDM
00262 2057 BD 2260        JSR    TOGGLA
00263 205A D6 63   INTRAX LDA B  CKBRDY
00264 205C C5 01          BIT B  #$01
00265 205E 27 0F          BEQ    INTRA
00266 2060 C8 02          EOR B  #$02
00267 2062 D7 63          STA B  CKBRDY    FLASH BCD
00268 2064 86 FF          LDA A  #$FF
00269 2066 C5 02          BIT B  #$02
00270 2068 26 02          BNE    INTRAY
00271 206A 96 4D          LDA A  CKBRDI
00272 206C BD 2256 INTRAY JSR    TOGGLE

00275                ◆ TEST    KEYBOARD INPUT PRESENT

00277 206F 86 FF   INTRA  LDA A  #$FF
00278 2071 B7 100A        STA A  PIA2BD    STROKE KEYBOARD
00279 2074 F6 1008        LDA B  PIA2AD
00280 2077 7F 100A        CLR    PIA2BD
00281 207A 53             COM B
00282 207B 26 12          BNE    KBRD
00283 207D 4F      INQRA  CLR A
00284 207E 8D 02          BSR    KBRCMP
00285 2080 20 35          BRA    KBODQ
00286                ◆◆◆
```

```
00330 20C2 97 46          STA A  CKBRDD
00331 20C4 96 45          LDA A  CKBRDC
00332 20C6 27 EE          BEQ    INTRBX
00333 20C8 0C             CLC
00334                ◆
00335 20C9 5D             TST B            WAIT FOR DIFFERENT CHAR.
00336 20CA 2B EA          BMI    INTRBX    LOOK FOR ANOTHER CHAR
00337 20CC CE 218B        LDX    #TABLE
00338 20CF BD 217D        JSR    TBLPNT    COMPUTE VECTOR
00339 20D2 A6 00          LDA A  0,X

00341 20D4 16             TAB
00342 20D5 C4 C0          AND B  #$C0

00344 20D7 C1 40          CMP B  #$40
00345 20D9 27 34          BEQ    INTRD     BRANCH IF NUMERIC
00346 20DB C1 80          CMP B  #$80
00347 20DD 27 14          BEQ    INTRGX    BRANCH IF ALPHA
00348 20DF 97 47   INTRK  STA A  CKBRDE    STORE IN COMMAND MAIL BOX
00349 20E1 96 47          LDA A  CKBRDE    TEST IF EXECUTE
00350 20E3 81 C5          CMP A  #$C5
00351 20E5 27 0F          BEQ    INTRK2
00352 20E7 96 53          LDA A  CKBRDM
00353 20E9 8A 20          ORA A  #$20      SETT CONTROL FLAG
00354 20EB 97 53          STA A  CKBRDM
00355 20ED BD 215B        JSR    INSSRD
00356 20F0 7E 22FA        JMP    CIDPRR
00357 20F3 7E 2170 INTRGX JMP    INTRG

00359 20F6 96 6F   INTRK2 LDA A  CKKJTS    IGNORE EXECUTE
00360 20F8 85 40          BIT A  #$40
00361 20FA 27 3F          BEQ    INTRB
00362 20FC 8E 03E6        LDS    #STACK
00363 20FF BD 215B        JSR    INSSRD
00364 2102 7F 004A        CLR    CKBRDH
00365 2105 7F 004B        CLR    CKBRDH+1
00366 2108 7F 004C        CLR    CKBRDH+2
00367 210B 0E             CLI
00368 210C 7E 43EB        JMP    EXECTE

00370 210F D6 53   INTRD  LDA B  CKBRDM    ADDRESS OR ALPHA?
00371 2111 C5 20          BIT B  #$20
00372 2113 27 27          BEQ    INTRE     BRANCH IF ALPHA
00373 2115 84 0F          AND A  #$0F      ELIMINATE FLAGS
00374 2117 D6 63          LDA B  CKBRDY
00375 2119 C4 FE          AND B  #$FE
00376 211B D7 63          STA B  CKBRDY
00377 211D D6 4D          LDA B  CKBRDI
00378                ◆◆◆
```

```
2144 D6 52          LDA B  CKBRDL    OUT OF RANGE TEST
2146 C1 41          CMP B  #$41
2148 2E 10          BGT    CMDRXX    EXIT
214A DE 51          LDX    CKBRDL-1
214C A7 00          STA A  0,X
214E 08             INX
214F 08             INX
2150 DF 51          STX    CKBRDL-1
2152 C1 41          CMP B  #$41      CURSOR ON?
2154 2C 04          BGE    CMDRXX
2156 86 40          LDA A  #$40
2158 A7 00          STA A  0,X
215A 3B       CMDRXX RTI
              *
              *
215B D6 53    INSSRD LDA B  CKBRDM
215D CA 01          ORA B  #$01
215F C4 3F          AND B  #$3F      RESET READYFLAG
2161 D7 53          STA B  CKBRDM    SET BLANK FLAG
2163 BD 2260        JSR    TOGGLA
2166 96 63          LDA A  CKBRDY
2168 84 74          AND A  #$74
216A 97 63          STA A  CKBRDY    RESET PREVENT ABORT FLAG
216C BD 2254        JSR    TOGGLD
216F 39             RTS

2170 D6 53    INTRG  LDA B  CKBRDM    PAGE OR OCDECODE
2172 C5 20          BIT B  #$20
2174 27 CC          BEQ    INTRF
2176 84 1F          AND A  #$1F      STORE IN COMMAND ADX
2178 8B 10          ADD A  #$10
217A 7E 20DF        JMP    INTRK
              * TAKE TABLE ADDRESS IN X-REGISTER AND ADDS
              * TO IT DISPLACEMENT IN A REGISTER

217D DF 43    TBLPNT STX    CXBRDX    COMPUTE X=REGISTER VECTOR
217F 5F             CLR B             CONTENT OF X PLUS
2180 9B 44          ADD A  CXBRDX+1  DISPLACEMENT STORED IN A-REG.
2182 D9 43          ADC B  CXBRDX
2184 97 44          STA A  CXBRDX+1
2186 D7 43          STA B  CXBRDX
2188 DE 43          LDX    CXBRDX    LOAD X WITH NEW VECTOR
218A 39             RTS
              ****************************************
              * CONVERSION TABLE
218B 00       TABLE  FCB    $00,$00   *,* BASE $80
218C 00
218D 00             FCB    $00,$00   *,*
218E 00
218F A2             FCB    $A2,$A3   A,B
2190 A3
2191 A4             FCB    $A4,$A5   C,D
2192 A5
2193 A6             FCB    $A6,$8C   E,F
2194 8C
2195 A7             FCB    $A7,$A8   G,H
2196 A8
2197 AA             FCB    $AA,$AB   I,J
2198 AB
2199 AC             FCB    $AC,$AD   K,L
219A AD
219B AE             FCB    $AE,$AF   M,N
219C AF
219D B2             FCB    $B2,$B3   O,P
219E B3
219F B4             FCB    $B4,$B5   Q,R
21A0 B5
21A1 B6             FCB    $B6,$B7   S,T
21A2 B7
21A3 B8             FCB    $B8,$BA   U,V
21A4 BA
```

```
00462 21A5 BB            FCB    $BB,$BC  W,X
      21A6 BC
00463 21A7 BD            FCB    $BD,$BE  Y,Z
      21A8 BE
00464 21A9 80            FCB    $80,$00  SPACE,*;
      21AA 00
00465 21AB C0            FCB    $C0,$C1  OPEN, LANE PRINT
      21AC C1
00466 21AD C2            FCB    $C2,$C3  LEAGUE, CONSOLE PRINT
      21AE C3
00467 21AF C4            FCB    $C4,$C5  OFF, EXECUTE
      21B0 C5
00468 21B1 00            FCB    $00,$00  *,*;BASE$C0
      21B2 00
00469 21B3 C6            FCB    $C6,$C7  LANE CLEAR, CONTROL/PAGE
      21B4 C7
00470 21B5 C8            FCB    $C8,$C9  DISPLAY PRACT.
      21B6 C9
00471 21B7 CA            FCB    $CA,$CB  RESET,SUSPEND CLEAR
      21B8 CB
00472 21B9 00            FCB    $00,$00  *,*
      21BA 00
00473 21BB 43            FCB    $43,$46  3,6;BASE $40
      21BC 46
00474 21BD 49            FCB    $49,$40  9,0
      21BE 40
00475 21BF 00            FCB    $00,$00  *,*
      21C0 00
00476 21C1 00            FCB    $00,$00  X,X
      21C2 00
00477 21C3 41            FCB    $41,$42  1,2
      21C4 42
00478 21C5 44            FCB    $44,$45  4,5
      21C6 45
00479 21C7 47            FCB    $47,$48  7,8
      21C8 48
00480 21C9 40            FCB    $40,$40  0,0
      21CA 40
00483                 *******************************************
00484                 * PAGE AND CONTROL PROCESSOR; RESET PROCESSOR
00485 21CB 0F         CONTRL SEI
00486 21CC 96 53             LDA A  CKBRDM   WHICH MODE?
00487 21CE 84 DF             AND A  #$DF     RESET CONTROL FLAG
00488 21D0 97 53             STA A  CKBRDM
00489                 *
00490                 *      [illegible]
00491 21D2 8D 72             BSR    SELDSP   SELECT LOCAL MONITOR CHANNEL
00492 21D4 BD 2260           JSR    TOGGLA   SET INDICATORS
00493 21D7 0E                CLI
00494 21D8 CE 2201           LDX    #TTPAGE
00495 21DB BD 4330           JSR    NOTPRO
00496                 *      [illegible]
00497                 *MESSAGE PROCESSOR
00498 21DE 0F         C22RL  SEI    [illegible]
00499 21DF 96 53             LDA A  CKBRDM
00500 21E1 8A 20             ORA A  #$20     [illegible]
00501 21E3 97 53             STA A  CKBRDM
00502 21E5 BD 2260           JSR    TOGGLA   [illegible]
00503 21E8 0E                CLI
00504 21E9 7D 005B           TST    CKBRDR   [illegible]
00505 21EC 26 49             BNE    RASET
00506 21EE CE 21FF           LDX    #TTP226  [illegible]
00507 21F1 BD 2707           JSR    OUTTXL
00508 21F4 96 6F             LDA A  CKKJTS
00509 21F6 85 10             BIT A  #$10
00510 21F8 26 02             BNE    C22RLX
00511 21FA 8D 40             BSR    RA2ET
00512 21FC 7E 2660    C22RLX JMP    CONTNU
00513                 *
```

```
00514 21FF DF        TTP22G FCB    $DF,$FF
      2200 FF
00515 2201 33        TTPAGE FCB    $33,$22,$27,$26,$00,$2E,$32,$25,$26,$
      2202 22
      2203 27
      2204 26
      2205 00
      2206 2E
      2207 32
      2208 25
      2209 26
      220A FF

00517 220B 7D 005B RESET  TST    CKBRDR
00518 220E 26 19          BNE    RES2T
00519 2210 86 FF          LDA A  #$FF      SET ELAPSE TIMER
00520 2212 97 4A          STA A  CKBRDH
00521 2214 96 6F          LDA A  CKKJTS
00522 2216 84 BF          AND A  #$BF
00523 2218 97 6F          STA A  CKKJTS
00524 221A 96 4B          LDA A  CKBRDH+1
00525 221C 8A F0          ORA A  #$F0
00526 221E 97 4B          STA A  CKBRDH+1
00527 2220 0E             CLI
00528 2221 8D 19          BSR    RA2ET
00529 2223 BD 34CA        JSR    REXET     DISPLY TEXT
00530 2226 7E 2668 RES7T  JMP    CONTNB    RETURN
00531                     *
00532 2229 7F 004A RES2T  CLR    CKBRDH
00533 222C 7F 005B        CLR    CKBRDR
00534 222F 7F 004B        CLR    CKBRDH+1
00535 2232 0E             CLI
00536 2233 8D 07          BSR    RA2ET
00537 2235 20 EF          BRA    RES7T

00539 2237 8D 03   RASET  BSR    RA2ET
00540 2239 7E 26F0        JMP    OUTTBL    OUTPUT TEXT

00542                     *
00543 223C CE 0001 RA2ET  LDX    #$01      RESET DISPLAY
00544 223F 6F 00   RA3ET  CLR    0,X
00545 2241 BD 413E        JSR    TSTXBT
00546 2244 24 F9          BCC    RA3ET

00548                     *
00549 2246 F6 1004 SELDSP LDA B  PIA1AD    SELECT LOCAL MONOTOR CHANNEL
00550 2249 C4 F7          AND B  #EFF
00551 224B F7 1004        STA B  PIA1AD
00552 224E C6 35          LDA B  #$35
00553 2250 F7 1009        STA B  PIA2AC
00554 2253 39             RTS

00557                     * TOGGLE SUBROUTINE
00558 2254 96 4D   TOGGLD LDA A  CKBPDI
00559 2256 C6 40   TOGGLE LDA B  #$40
00560 2258 85 F0          BIT A  #$F0
00561 225A 26 0A          BNE    TOGGLB
00562 225C 8A F0          ORA A  #$F0      CONVERT M.S. 0 OF BCD TO BLAN
00563 225E 20 06          BRA    TOGGLB
00564 2260 96 53   TOGGLA LDA A  CKBRDM
00565 2262 84 70          AND A  #$70
00566 2264 C6 80          LDA B  #$80      SET INDICATORS
00567 2266 43      TOGGLB COM A
00568 2267 B7 1006        STA A  PIA1BD    OUTPUT CODE IN A-REGISTER
00569 226A FA 1004        ORA B  PIA1AD    STROKE CODE IN B-REGISTER
00570 226D 8D 02          BSR    TOXGLE
00571 226F C4 3F          AND B  #$3F
00572 2271 F7 1004 TOXGLE STA B  PIA1AD
00573 2274 39             RTS
```

```
00575                   * POWER DOWN SEQUENCE
00576 2275 BF 03E6 PDOWN  STS    STACK    SAVE STACK POINTER
00577 2278 20 FE          BRA    *
00578                   ****************************************
00579                   * POWER-UP SEQUENCE
00580 227A 8E 03E6 COLDS  LDS    #STACK   INITIALIZE STACK POINTER
00581 227D CE 2003        LDX    #INTR
00582 2280 FF FFF8        STX    $FFF8    EXBUG INITIAL AID
00583 2283 CE 0000        LDX    #$00
00584 2286 4F             CLR A
00585 2287 A7 00   COLDSS STA A  0,X
00586 2289 08             INX
00587 228A 8C 0400        CPX    #$0400
00588 228D 26 F8          BNE    COLDSS
00589 228F 4F             CLR A
00590 2290 B7 1005        STA A  PIA1AC
00591 2293 B7 1007        STA A  PIA1BC
00592 2296 B7 1009        STA A  PIA2AC
00593 2299 B7 100B        STA A  PIA2BC
00594 229C B7 1011        STA A  PIA3AC
00595 229F B7 1013        STA A  PIA3BC
00596 22A2 86 FF          LDA A  #$FF
00597 22A4 B7 1010        STA A  PIA3AD   OUTPUT DATA PATHS
00598 22A7 B7 1012        STA A  PIA3BD

00600 22AA 86 03          LDA A  #$03
00601 22AC B7 1020        STA A  ACIAC    INITIALIZE ACIA
00602 22AF 86 1A          LDA A  #$1A
00603 22B1 B7 1020        STA A  ACIAC

00605 22B4 86 2C          LDA A  #$2C
00606 22B6 B7 1013        STA A  PIA3BC
00607 22B9 86 2C          LDA A  #$2C
00608 22BB B7 1011        STA A  PIA3AC

00610 22BE 86 35          LDA A  #TRD
00611 22C0 B7 1009        STA A  PIA2AC
00612 22C3 86 39          LDA A  #$39
00613 22C5 B7 100B        STA A  PIA2BC
00614 22C8 86 DE          LDA A  #$DE
00615 22CA B7 1004        STA A  PIA1AD
00616 22CD 86 FF          LDA A  #$FF

00618 22CF B7 1006        STA A  PIA1BD
00619 22D2 86 3C          LDA A  #TR4
00620 22D4 B7 1007        STA A  PIA1BC
00621 22D7 86 37          LDA A  #$37
00622 22D9 B7 1005        STA A  PIA1AC
00623 22DC 86 18          LDA A  #$18     TURN OFF ADDRESS SWITCH
00624 22DE B7 1004        STA A  PIA1AD
00625 22E1 B6 1010        LDA A  PIA3AD   START 5MS INTERRUPT
00626 22E4 B6 1004        LDA A  PIA1AD
00627 22E7 86 F1          LDA A  #$F1
00628 22E9 B7 01C2        STA A  CKBRDV   LAST DISPLAY ADDRESS

00630 22EC BD 2254        JSR    TOGGLD   SET BCD DISPLAY
00631 22EF 86 60          LDA A  #$60
00632 22F1 97 53          STA A  CKBRDM   SET READY FLAG
00633 22F3 BD 2260        JSR    TOGGLA   SET LED INDICATORS

00635 22F6 0E             CLI
00636 22F7 7E 2674 CXDRRR JMP    CONTNA

00638                   ****************************************
00639                   * COMMAND PROCESSOR ROUTINE
00640 22FA 8E 03E6 CIDPPR LDS    #STACK
00641 22FD 96 4B          LDA A  CKBRDH+1 RESET TIMER
00642 22FF 84 F0          AND A  #$F0
00643 2301 97 5B          STA A  CKBRDR
00644 2303 97 5C          STA A  CKBRDR+1
00645 2305 96 4B          LDA A  CKBRDH+1 LIST TIMER
00646 2307 84 0F          AND A  #$0F
```

```
00647 2309 97 59          STA A  CKBRDQ+1
00648 230B 96 4C          LDA A  CKBRDH+2 CLEAR ENABLE
00649 230D 97 5A          STA A  CKBRDQ+2
00650 230F 96 6F          LDA A  CKKJTS
00651 2311 84 BF          AND A  #$BF     RESET NOTICE FLAG
00652 2313 97 6F          STA A  CKKJTS
00653 2315 96 47          LDA A  CKBRDE
00654 2317 81 CA          CMP A  #$CA     RESET CODE
00655 2319 27 64          BEQ    CIXYZA
00656 231B 81 10          CMP A  #$10     SPACE CODE
00657 231D 27 63          BEQ    CIXYZB
00658 231F 81 17          CMP A  #$17     CLEAR ENABLE CODE
00659 2321 27 62          BEQ    CIXYZC
00660 2323 96 6F          LDA A  CKKJTS
00661 2325 16             TAB
00662 2326 84 E7          AND A  #$E7
00663 2328 97 6F          STA A  CKKJTS
00664 232A C5 08          BIT B  #$08
00665 232C 27 34          BEQ    CI2XYZ
00666 232E 8A 14          ORA A  #$14
00667 2330 97 6F          STA A  CKKJTS
00668 2332 96 4D          LDA A  CKBRDI
00669 2334 BD 264A        JSR    CON4UU
00670 2337 B7 01C8        STA A  CKBRDW
00671 233A B6 01C4        LDA A  CKBRDV+2
00672 233D BD 264A        JSR    CON4UU
00673 2340 B0 01C8        SUB A  CKBRDW
00674 2343 2F 0A          BLE    INTRBZ
00675 2345 96 4D          LDA A  CKBRDI
00676 2347 B7 01C3        STA A  CKBRDV+1
00677 234A B7 01C2        STA A  CKBRDV
00678 234D 20 10          BRA    CI3XYZ
00679 234F B6 01C4 INTRBZ LDA A  CKBRDV+2
00680 2352 B7 01C3        STA A  CKBRDV+1
00681 2355 B7 01C2        STA A  CKBRDV
00682 2358 D6 4D          LDA B  CKBRDI
00683 235A F7 01C4        STA B  CKBRDV+2
00684 235D 97 4D          STA A  CKBRDI
00685 235F BD 2256 CI3XYZ JSR    TOGGLE
00686 2362 7F 004A CI2XYZ CLR    CKBRDH
00687 2365 7F 004B        CLR    CKBRDH+1
00688 2368 7F 004C        CLR    CKBRDH+2
00689 236B 96 47   CIXYZ  LDA A  CKBRDE
00690 236D 84 3F          AND A  #$3F     REMOVE FLAG BITS
00691 236F 16             TAB
00692 2370 58             ASL B
00693 2371 1B             ABA            POINTER LOC SPACED BY 3
00694 2372 CE 41E2        LDX    #EXTBL
00695 2375 BD 217D        JSR    TBLPNT  COMPUTE ROUTINE POINTER
00696 2378 DF 70          STX    CKKJOS
00697 237A 96 59          LDA A  CKBRDQ+1
00698 237C 0E             CLI
00699 237D 6E 00          JMP    0,X     JUMP TO ROUTINE

00701 237F 7E 220B CIXYZA JMP    RESET
00702 2382 7E 34BA CIXYZB JMP    DUMSP
00703 2385 7E 3188 CIXYZC JMP    DUMY6
00706              ****************************************
00707              * DISPLAY PROCESSOR

00709 2388 0F      DISPLY SEI
00710 2389 96 53          LDA A  CKBRDM   RESET ROLL
00711 238B 16             TAB
00712 238C 84 F1          AND A  #$F1
00713 238E 97 53          STA A  CKBRDM
00714 2390 0E             CLI
00715 2391 7D 005B        TST    CKBRDR
00716 2394 27 18          BEQ    DISP6Y
00717 2396 C5 04          BIT B  #$04
00718 2398 27 14          BEQ    DISP6Y
00719 239A B6 01C5        LDA A  CKBRDV+3
```

```
00720 239D 0F              SEI
00721 239E 97 4D           STA A  CKBRDI
00722 23A0 BD 2256         JSR    TOGGLE
00723 23A3 0E       DISP7Y CLI
00724 23A4 D6 4D           LDA B  CKBRDI
00725 23A6 F7 01C5         STA B  CKBRDV+3
00726 23A9 8D 29           BSR    DISPLA
00727 23AB 7E 2660  DISP8Y JMP    CONTNU
00728 23AE 0F       DISP6Y SEI
00729 23AF 96 6F           LDA A  CKKJTS
00730 23B1 85 10           BIT A  #$10
00731 23B3 27 EE           BEQ    DISP7Y
00732 23B5 84 E7           AND A  #$E7
00733 23B7 97 6F           STA A  CKKJTS
00734 23B9 96 53           LDA A  CKBRDM    SET ROLL FLAG
00735 23BB 8A 04           ORA A  #$04
00736 23BD 97 53           STA A  CKBRDM
00737 23BF 0E              CLI
00738 23C0 B6 01C3         LDA A  CKBRDV+1
00739 23C3 B7 01C5         STA A  CKBRDV+3
00740 23C6 B7 01C6         STA A  CKBRDV+4
00741 23C9 B6 01C4         LDA A  CKBRDV+2
00742 23CC B7 01C7         STA A  CKBRDV+5
00743 23CF BD 26AD         JSR    CONT2A
00744 23D2 20 D7           BRA    DISP8Y
00745                ◆
00746 23D4 86 F9    DISPLA LDA A  #$F9      TRANSMIT RESET CODE
00747 23D6 BD 252D         JSR    OUTXMT
00748 23D9 F6 01C5         LDA B  CKBRDV+3
00749 23DC BD 2462         JSR    BCDB2Q
00750 23DF 25 35           BCS    DISPYX
00751 23E1 96 69           LDA A  CKBRDP+1
00752 23E3 81 FD           CMP A  #$FD
00753 23E5 27 2F           BEQ    DISPYX

00755 23E7 86 82           LDA A  #$82      M.S. BYTE OF PIA POINTER
00756 23E9 8D 24           BSR    DISPOX

00758 23EB 0F              SEI
00759 23EC B6 1004         LDA A  PIA1AD
00760 23EF 8A 08           ORA A  #TEN
00761 23F1 B7 1004         STA A  PIA1AD    SELECT M.S. CHANNEL
00762 23F4 86 3D           LDA A  #$3D      SELECT ADVERTISEMENT CHANNEL
00763 23F6 B7 1009         STA A  PIA2AC
00764 23F9 0E              CLI

00766 23FA 86 24           LDA A  #$24
00767 23FC D6 68           LDA B  CKBRDP
00768 23FE C5 40           BIT B  #$40
00769 2400 27 02           BEQ    DISPCA    RIGHT SIDE TURN-ON
00770 2402 86 1C           LDA A  #$1C      LEFT SIDE TURN-ON
00771 2404 8D 09    DISPCA BSR    DISPOX    PIA1BC
00772 2406 86 07           LDA A  #$07
00773 2408 8D 05           BSR    DISPOX
00774 240A 86 83           LDA A  #$83
00775 240C 8D 01           BSR    DISPOX
00776 240E 39              RTS
00777                ◆
00778 240F BD 252D  DISPOX JSR    OUTXMT
00779 2412 24 02           BCC    DISPYX
00780 2414 31              INS
00781 2415 31              INS
00782 2416 39       DISPYX RTS

00785                ◆ PIA1BC=$1007 ($82,$1C); CB2=0: $30; CB2=1: $38
00786                ◆ PIA2AC=$1009 ($82,$24); CA4=0: $35; CA2=1: $3D
```

```
00790                   ****************************************
00791                   * OFF PROCESSOR
00792                   *
00793 2417 27 03        MSOFF  BEQ    M1OFF
00794 2419 7E 3677      MSOOFF JMP    DUMMYO
00795                   *
00796 241C CE 368C      M1OFF  LDX    #TTTDO
00797 241F BD 4330             JSR    NOTPRO
00798 2422 BD 2460             JSR    BCDBIT   SELECT NEW UNIT
00799 2425 25 F2               BCS    MSOOFF
00800 2427 86 FC               LDA A  #$FC     TRANSMIT DATAVO POINTER
00801 2429 8D 2A               BSR    M1OFFX
00802 242B 86 2E               LDA A  #$2E
00803 242D 8D 26               BSR    M1OFFX
00804 242F 86 27               LDA A  #$27     RESET MODE CODE
00805 2431 7D 005B             TST    CKBRDR   RESET TIMER ELAPSED?
00806 2434 26 02               BNE    MSXFF
00807 2436 86 07               LDA A  #$07     SET MODE CODE
00808 2438 8D 1B        MSXFF  BSR    M1OFFX   SEND MODE CODE

00810 243A 86 2B               LDA A  #$2B     OFF FLAG POSITION
00811 243C 8D 17               BSR    M1OFFX
00812 243E 86 82               LDA A  #$82
00813 2440 8D 13               BSR    M1OFFX
00814 2442 86 1C               LDA A  #$1C
00815 2444 8D 0F               BSR    M1OFFX
00816 2446 86 83               LDA A  #$83
00817 2448 8D 0B               BSR    M1OFFX
00818 244A 86 24               LDA A  #$24
00819 244C 8D 07               BSR    M1OFFX
00820 244E 86 83               LDA A  #$83
00821 2450 8D 03               BSR    M1OFFX
00822 2452 0D                  SEC
00823 2453 20 C4               BRA    MSOOFF
00824 2455 BD 252D      M1OFFX JSR    OUTXMT
00825 2458 24 05               BCC    M2OFFX
00826 245A 32                  PUL A
00827 245B 32                  PUL A
00828 245C 0D                  SEC
00829 245D 20 BA               BRA    MSOOFF
00830 245F 39           M2OFFX RTS
00831                   ****************************************

00834                   * BCD TO BINARY CONVERSION SUBROUTINE
00835                   *
00836 2460 D6 4D        BCDBIT LDA B  CKBRDI
00837 2462 D7 4E        BCDB20 STA B  CKBRDI+1
00838 2464 26 04               BNE    BCDBIA   UNIT SELECTED,BRANCH
00839 2466 86 3D               LDA A  #$3D     NO UNIT SELECTED
00840 2468 20 25               BRA    BCDBIE   OUTPUT ADDRESS 60

00842 246A C1 99        BCDBIA CMP B  #$99     ALL UNITS ADDRESS
00843 246C 26 04               BNE    BCDBIB   OUTPUT ADDRESS 63
00844 246E 86 3F               LDA A  #$3F
00845 2470 20 1D               BRA    BCDBIE

00847 2472 86 10        BCDBIB LDA A  #$10
00848 2474 58           BCDBIC ASL B           CONVERT BCD CODE, SET DELIMIT
00849 2475 24 02               BCC    BCDBID   TEST MS BIT OF BCD
00850 2477 8B 0A               ADD A  #$0A     ADD 10 IF M.S. SET
00851 2479 4D           BCDBID TST A           END OF CONVERSION?
00852 247A 2B 03               BMI    BCDBIF   DELIMITER DETECTED,END
00853 247C 48                  ASL A           SHIFT INTERIOR CONVERSION RES
00854 247D 20 F5               BRA    BCDBIC
00855 247F 84 7F        BCDBIF AND A  #$7F     ELIMINATE DELIMITER BIT
00856 2481 D6 4E               LDA B  CKBRDI+1 GET LS DIGIT
00857 2483 C4 0F               AND B  #$0F
00858 2485 1B                  ABA             ADD TO INTERIOR CONVERSION RE
00859 2486 4A                  DEC A           ADD L/F DESIGNATOR
00860 2487 0D                  SEC             CONVERT TO UNIT ADDRESS
```

```
00861 2488 46              ROR A
00862 2489 C5 01           BIT B  #$01      SET BIT 6 IF LEFT
00863 248B 27 02           BEQ    BCDBIE    PREFIX 10 DESIGNATES RIGHT
00864 248D 8A C0           ORA A  #$C0      PREFIX 11 DESIGNATES LEFT
00865 248F 97 68   BCDBIE  STA A  CKBRDP    STORE IN REGISTER
00866                ◆
00867 2491 48              ASL A
00868 2492 0D              SEC              A-REGISTER CONTAINS
00869 2493 49              ROL A            ADDRESS
00872                ◆ COMMAND OUTPUT PROCESSOR SUBROUTINE
00873 2494 0E      DUPXMT  CLI
00874 2495 97 54           STA A  CKBRDN    SSTORE OUTPUT IN SCRATCH
00875 2497 16              TAB
00876 2498 C4 03           AND B  #$03
00877 249A C1 01           CMP B  #$01      ADDRESS?
00878 249C 26 06           BNE    DUSXMT
00879 249E C1 F9           CMP B  #$F9
00880 24A0 27 02           BEQ    DUSXMT
00881 24A2 97 69           STA A  CKBRDP+1
00882 24A4 7F 0056 DUSXMT  CLR    CKBRDO
00883 24A7 96 49           LDA A  CKBRDG    TEST IF TIMER ELAPSED
00884 24A9 27 05           BEQ    DUTXNT
00885 24AB BD 4245         JSR    PRINTR
00886 24AE 20 F4           BRA    DUSXMT

00888 24B0 F6 1021 DUTXNT  LDA B  ACIAD     CLEAR INPUT REGISTER
00889 24B3 F6 1020         LDA B  ACIAC
00890 24B6 C5 02           BIT B  #$02      OUTPUT READY?
00891 24B8 26 05           BNE    DUTXOT    NO, WAIT
00892 24BA BD 4245         JSR    PRINTR
00893 24BD 20 F1           BRA    DUTXNT
00894                ◆
00895 24BF 96 54   DUTXOT  LDA A  CKBRDN    GET COUT CHARACTER
00896 24C1 B7 1021         STA A  ACIAD
00897 24C4 0F              SEI
00898 24C5 86 03           LDA A  #$03      SET X UNIT TIMER
00899 24C7 97 49           STA A  CKBRDG
00900 24C9 0E              CLI
00901 24CA B6 1021         LDA A  ACIAD
00902 24CD F6 1020 DUTXPT  LDA B  ACIAC
00903 24D0 C5 01           BIT B  #$01      INPUT READY
00904 24D2 26 0A           BNE    DUTXOO    NO, WAIT
00905 24D4 BD 4245         JSR    PRINTR
00906 24D7 7D 0049         TST    CKBRDG
00907 24DA 27 1D           BEQ    DUTXQT
00908 24DC 20 EF           BRA    DUTXPT
00909 24DE 96 69   DUTXOO  LDA A  CKBRDP+1
00910 24E0 81 FD           CMP A  #$FD
00911 24E2 27 37           BEQ    DUTZQQ    SKIP ECHOPLEX TEST EXIT
00912 24E4 96 54           LDA A  CKBRDN
00913 24E6 81 F9           CMP A  #$F9
00914 24E8 27 31           BEQ    DUTZQQ
00915 24EA C5 70           BIT B  #$70      TRANSMISSION ERRORS?
00916 24EC 26 0B           BNE    DUTXQT    ERROR, RETRANSMIT
00917 24EE B6 1021         LDA A  ACIAD
00918 24F1 90 54           SUB A  CKBRDN
00919 24F3 26 04           BNE    DUTXQT
00920 24F5 7F 0049         CLR    CKBRDG    CLEAR TIMER
00921 24F8 39              RTS
00922 24F9 96 56   DUTXQT  LDA A  CKBRDO    RETRANSMIT?
00923 24FB 7C 0056         INC    CKBRDO
00924 24FE 81 04           CMP A  #$04
00925 2500 2F AE           BLE    DUTXNT    YES,TRY AGAIN
00926 2502 96 63           LDA A  CKBRDY
00927 2504 85 88           BIT A  #$88
00928 2506 26 0E           BNE    DUTXXX
00929 2508 96 54           LDA A  CKBRDN
00930 250A 81 F9           CMP A  #$F9      RESTORE CODE
00931 250C 27 1B           BEQ    DUTX2X
00932 250E 0F      DUTXZT  SEI
00933 250F 96 63           LDA A  CKBRDY    SET ABORT FLAG
```

```
00934 2511 8A 01          ORA A  #$01
00935 2513 97 63          STA A  CKBRDY
00936 2515 0E             CLI
00937 2516 B6 1021 OUTXXX LDA A  ACIAD    CLEAR INPUT FLAG
00938 2519 0D             SEC
00939 251A 39             RTS
00940 251B 0F      OUTZQQ SEI
00941 251C 86 02          LDA A  #$02
00942 251E 97 49          STA A  CKBRDG
00943 2520 0E             CLI
00944 2521 BD 4245 OUTZQR JSR    PRINTR
00945 2524 7D 0049        TST    CKBRDG
00946 2527 26 F8          BNE    OUTZQR   WAIT 3X8MS.
00947 2529 B6 1021 OUTX2X LDA A  ACIAD    RESET INPUT
00948 252C 39      OUTZQT RTS
00949              *
00950 252D 0F      OUTXMT SEI
00951 252E D6 63          LDA B  CKBRDY
00952 2530 CA 08          ORA B  #$08
00953 2532 D7 63          STA B  CKBRDY
00954 2534 0E             CLI
00955 2535 BD 2494        JSR    OURXMT
00956 2538 24 F2          BCC    OUTZQT
00957 253A 96 54          LDA A  CKBRDN
00958 253C 84 03          AND A  #$03     ADDRESS?
00959 253E 81 01          CMP A  #$01
00960 2540 27 D4          BEQ    OUTXXX
00961 2542 96 54          LDA A  CKBRDN
00962 2544 97 55          STA A  CKBRDN+1
00963 2546 0F             SEI
00964 2547 96 63          LDA A  CKBRDY
00965 2549 84 F7          AND A  #$F7
00966 254B 97 63          STA A  CKBRDY
00967 254D 0E             CLI
00968 254E 96 69          LDA A  CKBRDP+1
00969 2550 BD 2494        JSR    OURXMT
00970 2553 25 D7          BCS    OUTZQT
00971 2555 96 55          LDA A  CKBRDN+1
00972 2557 BD 2494        JSR    OURXMT
00973 255A 39             RTS

00976              ***********************************************

00978              * STEP TO NEXT MONITOR

00980 255B 0F      CDTNXT SEI
00981 255C D6 63          LDA B  CKBRDY   RESET RECYCLE AND ABORT FLAGS
00982 255E C4 FA          AND B  #$FA
00983 2560 D7 63          STA B  CKBRDY

00985 2562 B6 01C5        LDA A  CKBRDV+3
00986 2565 8B 01          ADD A  #$01
00987 2567 19             DAA
00988 2568 B7 01C5        STA A  CKBRDV+3
00989 256B BD 264A        JSR    CDN4UU
00990 256E B7 01C8        STA A  CKBRDW
00991 2571 B6 01C7        LDA A  CKBRDV+5
00992 2574 BD 264A        JSR    CDN4UU
00993 2577 B0 01C8        SUB A  CKBRDW
00994 257A 2C 06          BGE    CDN3CC
00995 257C B6 01C6        LDA A  CKBRDV+4
00996 257F B7 01C5        STA A  CKBRDV+3
00997 2582 0E      CDN3CC CLI
00998 2583 39             RTS
00999              *
01000              * ROLL DISPLAY PROCESSOR
01001              *
01002 2584 0F      CDSNXT SEI
01003 2585 96 53          LDA A  CKBRDM
01004 2587 7D 005B        TST    CKBRDR
01005 258A 26 0D          BNE    CDS2ZT
```

```
01006 258C 84 F3          AND A  #$F3      RESET ROLL FLAGS
01007 258E 97 53   COSNYT STA A  CKBRDM
01008 2590 0E             CLI
01009 2591 8D C8          BSR    COTNXT
01010 2593 BD 23D4        JSR    DISPLA
01011 2596 7E 2668        JMP    CONTNB

01013 2599 8A 0C   COS2ZT ORA A  #$0C      SET ROLL FLAGS
01014 259B 20 F1          BRA    COSNYT

01016                 * RANGE PROCESSOR
01017 259D 7D 005B COSNZT TST    CKBRDR
01018 25A0 26 49          BNE    COSMZT
01019 25A2 96 6F          LDA A  CKKJTS
01020 25A4 85 04          BIT A  #$04
01021 25A6 26 2A          BNE    COSPZT
01022 25A8 96 4D          LDA A  CKBRDI
01023 25AA B7 01C4        STA A  CKBRDV+2 STORE TOP ADDRESS
01024 25AD 7F 01C2        CLR    CKBRDV
01025 25B0 86 00          LDA A  #$00      PRESET BOTTOM ADDRESS
01026 25B2 0F             SEI
01027 25B3 97 4D          STA A  CKBRDI
01028 25B5 BD 2256        JSR    TOGGLE
01029 25B8 96 6F          LDA A  CKKJTS    SET RANGE FLAG
01030 25BA 8A 08          ORA A  #$08      TO LOOK FOR BOTTOM ADDRESS NE
01031 25BC 97 6F          STA A  CKKJTS
01032 25BE 0E             CLI
01033 25BF BD 223C        JSR    RA2ET
01034 25C2 CE 25F9        LDX    #TTTRG
01035 25C5 DF 64          STX    CKBRDZ
01036 25C7 CE 0101        LDX    #$101
01037 25CA DF 51          STX    CKBRDL-1
01038 25CC BD 40DB        JSR    TSTTAT
01039 25CF 7E 2674 COSQZT JMP    CONTNA
01040                 *
01041 25D2 84 EF   COSRZT AND A  #$EF
01042 25D4 8A 08          ORA A  #$08
01043 25D6 97 6F          STA A  CKKJTS
01044 25D8 B6 01C3        LDA A  CKBRDV+1
01045 25DB B7 01C2        STA A  CKBRDV
01046 25DE 97 4D          STA A  CKBRDI
01047 25E0 BD 223C        JSR    RA2ET
01048 25E3 CE 0101        LDX    #$101
01049 25E6 BD 437C        JSR    NOTC7
01050 25E9 20 E4          BRA    COSQZT
01051                 *
01052 25EB 7F 005B COSMZT CLR    CKBRDR
01053 25EE BD 223C        JSR    RA2ET
01054 25F1 96 6F          LDA A  CKKJTS
01055 25F3 84 E3          AND A  #$E3
01056 25F5 97 6F          STA A  CKKJTS
01057 25F7 20 D6          BRA    COSQZT
01058                 *
01059 25F9 26      TTTRG  FCB    $26,$2F,$37,$26,$35,$00
      25FA 2F
      25FB 37
      25FC 26
      25FD 35
      25FE 00
01060 25FF 32             FCB    $32,$37,$28,$26,$35,$00
      2600 37
      2601 28
      2602 26
      2603 35
      2604 00
01061 2605 2D             FCB    $2D,$22,$2F,$26,$00
      2606 22
      2607 2F
      2608 26
      2609 00
```

```
01062 260A 2F              FCB     $2F,$38,$2E,$23,$26,$35,$FF
      260B 38
      260C 2E
      260D 23
      260E 26
      260F 35
      2610 FF
01063                 *
01065                 * BLOCK PROCESSING
01066 2611 0F         CON2NA SEI
01067 2612 D6 63             LDA B   CKBRDY
01068 2614 C4 FE             AND B   #$FE
01069 2616 D7 63             STA B   CKBRDY    RESET ABORT
01070 2618 0E                CLI
01071 2619 B6 01C2           LDA A   CKBRDV
01072 261C 8B 01             ADD A   #$01
01073 261E 19                DAA
01074 261F B7 01C2           STA A   CKBRDV
01075 2622 8D 26             BSR     CON4UU
01076 2624 B7 01C8           STA A   CKBRDW
01077 2627 B6 01C4           LDA A   CKBRDV+2 GET TOP ADDRESS
01078 262A 8D 1E             BSR     CON4UU
01079 262C B0 01C8           SUB A   CKBRDW
01080 262F 2E 08             BGT     CON2UU
01081                 *
01082 2631 0F                SEI
01083 2632 D6 6F             LDA B   CKKJTS    RESET ROLL FLAG
01084 2634 C4 EF             AND B   #$EF
01085 2636 D7 6F             STA B   CKKJTS
01086 2638 0E                CLI
01087 2639 B6 01C2 CON2UU    LDA A   CKBRDV
01088 263C 0F                SEI
01089 263D 97 4D             STA A   CKBRDI
01090 263F BD 2256           JSR     TOGGLE
01091 2642 0E                CLI
01092 2643 96 5C             LDA A   CKBRDR+1
01093 2645 97 5B             STA A   CKBRDR
01094 2647 7E 43EB           JMP     EXECTE
01095                 *
01096 264A 16         CON4UU TAB               HEX TO BINARY CONVERSTION
01097 264B C4 0F             AND B   #$0F
01098 264D F7 01C9           STA B   CKBRDW+1
01099 2650 84 F0             AND A   #$F0      MS DIGIT
01100 2652 44                LSR A
01101 2653 16                TAB
01102 2654 FB 01C9           ADD B   CKBRDW+1
01103 2657 F7 01C9           STA B   CKBRDW+1
01104 265A 44                LSR A
01105 265B 44                LSR A
01106 265C BB 01C9           ADD A   CKBRDW+1
01107 265F 39                RTS

01110 2660 8D 4B      CONTNU BSR     CONT2A
01111 2662 96 6F             LDA A   CKKJTS
01112 2664 85 10             BIT A   #$10      BLOCK PROCESSING?
01113 2666 26 A9             BNE     CON2NA    YES, BRANCH
01114 2668 0F         CONTNB SEI
01115 2669 96 53             LDA A   CKBRDM
01116 266B 84 7F             AND A   #$7F      RESET FLASH,SET READY
01117 266D 8A 40             ORA A   #$40
01118 266F 97 53             STA A   CKBRDM
01119 2671 BD 2260           JSR     TOGGLA
01120 2674 8D 37      CONTNA BSR     CONT2A
01121 2676 BD 4245           JSR     PRINTR

01123 2679 86 FD             LDA A   #$FD      SELECT ALL UNITS
01124 267B BD 344B           JSR     INITYZ
01125 267E B6 1021           LDA A   ACIAD
01126 2681 86 03             LDA A   #$03      SET TIMER
01127 2683 97 49             STA A   CKBRDG
01128 2685 B6 1020 CONTNX    LDA A   ACIAC
```

```
01129 2688 85 01          BIT A  #$01
01130 268A 27 12          BEQ    COVTNX
01131 268C 0F             SEI
01132 268D 96 53          LDA A  CKBRDM
01133 268F 8A 10          ORA A  #$10      SET INTERRUPT
01134 2691 97 53   COUTNX STA A  CKBRDM
01135 2693 0E      COTTNX CLI
01136 2694 BD 2260        JSR    TOGGLA
01137 2697 86 F5          LDA A  #$F5      NO-UNIT ADDRESS
01138 2699 BD 252D        JSR    OUTXMT
01139 269C 20 D6          BRA    CONTNA
01140 269E BD 4245 COVTNX JSR    PRINTR
01141 26A1 7D 0049        TST    CKBRDG
01142 26A4 26 DF          BNE    COWTNX
01143 26A6 0F             SEI
01144 26A7 96 53          LDA A  CKBRDM
01145 26A9 84 EF          AND A  #$EF      RESET INERRUPT
01146 26AB 20 E4          BRA    COUTNX
01147                ◆
01148 26AD 0F      CONT2A SEI
01149 26AE 96 63          LDA A  CKBRDY    SET PREVENT ABORT FLAG
01150 26B0 8A 80          ORA A  #$80
01151 26B2 97 63          STA A  CKBRDY
01152 26B4 0E             CLI
01153 26B5 96 53          LDA A  CKBRDM
01154 26B7 84 0C          AND A  #$0C      ROLLING?
01155 26B9 81 04          CMP A  #$04
01156 26BB 26 10          BNE    CONTOA    NO,RETURN
01157 26BD BD 23D4        JSR    DISPLA
01158 26C0 0F             SEI
01159 26C1 25 06          BCS    CONTOX    ERROR,RETURN
01160 26C3 96 53          LDA A  CKBRDM
01161 26C5 8A 08          ORA A  #$08
01162 26C7 97 53          STA A  CKBRDM
01163 26C9 BD 255B CONTOX JSR    COTNXT
01164 26CC 0E
01165 26CD 39      CONTOA RTS
01166                ◆

01169                ◆ TOPROW CHARACTER TABLE
01170 26CE 1E      TOPROW FCB    $1E,$33,$2D,$35
      26CF 33
      26D0 2D
      26D1 35
01171 26D2 1E             FCB    $1E,$01,$1E,$02
      26D3 01
      26D4 1E
      26D5 02
01172 26D6 1E             FCB    $1E,$03,$1E,$04
      26D7 03
      26D8 1E
      26D9 04
01173 26DA 1E             FCB    $1E,$05,$1E,$06
      26DB 05
      26DC 1E
      26DD 06
01174 26DE 1E             FCB    $1E,$07,$1E,$08
      26DF 07
      26E0 1E
      26E1 08
01175 26E2 1E             FCB    $1E,$09,$1E,$01
      26E3 09
      26E4 1E
      26E5 01
01176 26E6 32             FCB    $32,$1E,$37,$32
      26E7 1E
      26E8 37
      26E9 32
01177 26EA 37             FCB    $37,$1E,$28,$25
      26EB 1E
      26EC 28
      26ED 25
```

```
01178 26EE 33              FCB    $33,$FF
      26EF FF

01180                 * TOPROW RESTORE PROCESSOR SUBROUTINE
01181 26F0 CE 26CE OUTTBL LDX    #TOPROW
01182 26F3 8D 12           BSR    OUTTXL
01183 26F5 7E 2660         JMP    CONTNU

01186                 * PRACTICE PLAY TABLE
01187 26F8 1E         PRACTY FCB    $1E,$33,$35,$22
      26F9 33
      26FA 35
      26FB 22
01188 26FC 24              FCB    $24,$37,$2A,$24
      26FD 37
      26FE 2A
      26FF 24
01189 2700 26              FCB    $26,$1E,$33,$2D
      2701 1E
      2702 33
      2703 2D
01190 2704 22              FCB    $22,$3D,$FF
      2705 3D
      2706 FF

01193                 ****************************************
01194                 * LINE TEXT
01195 2707 DF 61      OUTTXL STX    CKBRDX+2
01196 2709 D6 6F             LDA B  CKKJTS
01197 270B C4 DF             AND B  #$DF      RESET PAGE MESSAGE FLAG
01198 270D A6 00             LDA A  0,X
01199 270F 81 DF             CMP A  #$DF
01200 2711 26 07             BNE    OU52L
01201 2713 CE 0001           LDX    #$01
01202 2716 DF 61             STX    CKBRDX+2
01203 2718 CA 20             ORA B  #$20      SET PAGE MESSAGE FLAG
01204 271A D7 6F      OU52L  STA B  CKKJTS
01205 271C 0F                SEI
01206 271D 96 63             LDA A  CKBRDY    SET SCAN FLAG
01207 271F 8A 20             ORA A  #$20
01208 2721 97 63             STA A  CKBRDY
01209 2723 0E                CLI
01210 2724 BD 2460           JSR    BCDBIT    SELECT UBIT
01211 2727 25 34             BCS    OUTCZL
01212 2729 86 D7             LDA A  #$D7
01213 272B BD 27E6           JSR    CMDKX8    FAST SCAN OUTPUT
01214 272E DE 61      OUT2ZL LDX    CKBRDX+2
01215 2730 7F 0052           CLR    CKBRDL
01216 2733 DF 5F             STX    CKBRDX
01217 2735 86 00             LDA A  #$00      SELECT MEMORY
01218 2737 BD 27F3           JSR    CMDKX7
01219 273A 86 02             LDA A  #$02
01220 273C BD 27F3           JSR    CMDKX7
01221                 *
01222 273F DE 5F      OUTTZL LDX    CKBRDX
01223 2741 A6 00             LDA A  0,X       CHECK IF END CHARACTER?
01224 2743 81 7F             CMP A  #$7F      LANE #
01225 2745 27 17             BEQ    OUTYYL
01226 2747 81 FF             CMP A  #$FF
01227 2749 27 46             BEQ    OUTTYL    BRANCH IF IT IS
01228 274B 08                INX              INCREMRNT POINT FOR NEXT
01229 274C D6 6F             LDA B  CKKJTS
01230 274E C5 20             BIT B  #$20      PAGE MESSAGE?
01231 2750 27 01             BEQ    OU25L     NO
01232 2752 08                INX
01233 2753 DF 5F      OU25L  STX    CKBRDX
01234 2755 20 3C             BRA    OUT6ZL
01235                 *
01236 2757 96 69      OUTDYL LDA A  CKBRDP+1
01237 2759 44                LSR A
```

```
01238 275A 44                LSR A
01239 275B 8A 80             ORA A  #$80
01240 275D 39        OUTCZL  RTS

01242 275E 8D F7     OUTYYL  BSR    OUTDYL
01243 2760 8A C0             ORA A  #$C0      LEFT
01244 2762 8D 13             BSR    OUTAYL
01245 2764 8D F1             BSR    OUTDYL
01246 2766 8D 0F             BSR    OUTAYL
01247 2768 8D ED             BSR    OUTDYL
01248 276A 8A C0             ORA A  #$C0
01249 276C 8D 15             BSR    OUTBYL
01250 276E 8D E7             BSR    OUTDYL
01251 2770 8D 11             BSR    OUTBYL
01252 2772 7C 0060           INC    CKBRDX+1
01253 2775 20 1A             BRA    OUTTYL
01254                 * COMPUTE LANE NUMBER
01255 2777 BD 3000   OUTAYL  JSR    DSPLBV
01256 277A 44                LSR A
01257 277B 44                LSR A
01258 277C 44                LSR A
01259 277D 44                LSR A
01260 277E 97 48             STA A  CKBRDF
01261 2780 7E 27BE           JMP    CMDKXX
01262                 *
01263 2783 BD 3000   OUTBYL  JSR    DSPLBV
01264 2786 84 0F             AND A  #$0F      CONVERT 0 TO D
01265 2788 26 02             BNE    OUTCYL
01266 278A 86 32             LDA A  #$32
01267 278C 97 48     OUTCYL  STA A  CKBRDF
01268 278E 7E 27BE           JMP    CMDKXX

01270                 *
01271 2791 86 1E     OUTTYL  LDA A  #$1E      OUTPUT SPACE WHEN DELIMITER
01272 2793 97 48     OUT6ZL  STA A  CKBRDF    STORRE IN DATA MAIL BOX
01273 2795 8D 27             BSR    CMDKXX
01274 2797 8D 25             BSR    CMDKXX
01275 2799 96 52             LDA A  CKBRDL
01276 279B 81 41             CMP A  #$41      OUT OF RANGE
01277 279D 2F A0             BLE    OUTTZL    NO,NEXT CHARACTER
01278 279F 96 63             LDA A  CKBRDY    RECYCLE OTHER HALF?
01279 27A1 16                TAB
01280 27A2 84 DF             AND A  #$DF      RESET FLAG
01281 27A4 97 63             STA A  CKBRDY
01282 27A6 C5 20             BIT B  #$20
01283 27A8 26 84             BNE    OUT2ZL
01284 27AA 7F 0051           CLR    CKBRDL-1
01285 27AD 86 47             LDA A  #$47      RESET FAST SCAN MODE
01286 27AF 8D 35             BSR    CMDKX8
01287 27B1 7F 0049           CLR    CKBRDG
01288 27B4 0E                CLI
01289 27B5 86 47             LDA A  #$47
01290 27B7 BD 252D           JSR    OUTXMT
01291 27BA 7F 0052           CLR    CKBRDL
01292 27BD 39                RTS
01293                 *
01294                 *
01295 27BE CE 0080   CMDKXX  LDX    #$80      ENFAST SCAN OUTPUT
01296 27C1 7C 0052           INC    CKBRDL    INCR.COUNTER
01297 27C4 F6 1020   CMDKX2  LDA B  ACIAC
01298 27C7 C5 02             BIT B  #$02      OUTPUT READY?
01299 27C9 27 F9             BEQ    CMDKX2    NO, WAIT
01300 27CB 96 48             LDA A  CKBRDF    GET CHARACTER
01301 27CD D6 63             LDA B  CKBRDY    MS OR LS HALF-BYTE?
01302 27CF C5 20             BIT B  #$20
01303 27D1 26 08             BNE    CMDKX3    LS HALF BYTE
01304 27D3 48                ASL A
01305 27D4 48                ASL A
01306 27D5 48                ASL A
01307 27D6 48                ASL A
```

```
01308 27D7 8A 03          ORA A  #$03     LS HALF BYTE
01309 27D9 20 04          BRA    CMDKX4
01310 27DB 84 F0   CMDKX3 AND A  #$F0     MS HALF BYTE
01311 27DD 8A 0B          ORA A  #$0B
01312 27DF B7 1021 CMDKX4 STA A  ACIAD    OUTPUT CODE
01313 27E2 09      CMDKX5 DEX
01314 27E3 26 FD          BNE    CMDKX5   WAIT UNTIL TIME ELAPSED
01315 27E5 39             RTS
01316              *
01317 27E6 0F      CMDKX8 SEI
01318 27E7 CE 0300        LDX    #$0300
01319 27EA F6 1020 CMDKX9 LDA B  ACIAC
01320 27ED C5 02          BIT B  #$02
01321 27EF 27 F9          BEQ    CMDKX9
01322 27F1 20 EC          BRA    CMDKX4
01323 27F3 0F      CMDKX7 SEI
01324 27F4 CE 0080        LDX    #$80
01325 27F7 20 F1          BRA    CMDKX9

01327              ****************************************
01328              ****************************************
01329 3000                ORG    $3000
01330              ****************************************
01331              ****************************************
01332              * CONVERT BINARY CODE TO BCD

01334 3000 16      DSPLBV TAB
01335 3001 59             ROL B
01336 3002 24 03          BCC    DSP2BV
01337 3004 C8 80          EOR B  #$80
01338 3006 59             ROL B
01339 3007 49      DSP2BV ROL A
01340 3008 16             TAB
01341 3009 84 07          AND A  #$07
01342 300B 8B 01          ADD A  #$01
01343 300D C5 08          BIT B  #$08
01344 300F 27 03          BEQ    DISPL2
01345 3011 8B 08          ADD A  #$08
01346 3013 19             DAA
01347 3014 C5 10   DISPL2 BIT B  #$10
01348 3016 27 03          BEQ    DISPL3
01349 3018 8B 16          ADD A  #$16
01350 301A 19             DAA
01351 301B C5 20   DISPL3 BIT B  #$20
01352 301D 27 03          BEQ    DISPL4
01353 301F 8B 32          ADD A  #$32
01354 3021 19             DAA
01355 3022 C5 40   DISPL4 BIT B  #$40
01356 3024 27 03          BEQ    DISPL5
01357 3026 8B 64          ADD A  #$64
01358 3028 19             DAA
01359 3029 39      DISPL5 RTS

01363              * PRACTICE PLAY PROCESSORS
01364 302A 27 03   PRATCE BEQ    P1ATCE
01365 302C 7E 369C PPXTCE JMP    DUMMYT
01366 302F CE 36B1 P1ATCE LDX    #TTTDT
01367 3032 BD 4330        JSR    NOTPRO
01368 3035 7D 005B        TST    CKBRDR
01369 3038 26 0C          BNE    PRBTCE   EXIT PRACTICE MODE
01370 303A CE 26F8        LDX    #PRACTY  DISPLAY TEXT
01371 303D BD 2707        JSR    OUTTXL
01372 3040 25 26          BCS    PRDTCE
01373 3042 86 07          LDA A  #$07     SET PRACTICE PLAY FLAG
01374 3044 20 0A          BRA    PRCTCE

01376 3046 CE 26CE PRBTCE LDX    #TOPROW
01377 3049 BD 2707        JSR    OUTTXL   REPLACE TOP ROW TEXT
01378 304C 25 1A          BCS    PRDTCE
01379 304E 86 27          LDA A  #$27     RESET PRACTICE FLAG
01380 3050 BD 252D PRCTCE JSR    OUTXMT   SET MODE CODE
```

```
3053 25 13          BCS    PRDTCE
3055 86 1E          LDA A  #$1E      SET MEMORY POINTER TO DATAUR
3057 BD 252D        JSR    OUTXMT
305A 25 0C          BCS    PRDTCE
305C 86 F8          LDA A  #$F8      L.S. POINTER BYTE
305E BD 252D        JSR    OUTXMT
3061 25 05          BCS    PRDTCE
3063 86 23          LDA A  #$23      OUTPUT BIT POSITION 02
3065 BD 252D        JSR    OUTXMT
3068 0D      PRDTCE SEC
3069 20 C1          BRA    PRXTCE

                 *-PRINT ACTIVATION PROCESSOR
306B 27 03   MSPRNT BEQ    M1PRNT
306D 7E 3786 MSXRNY JMP    M2PRNT
                 *
3070 CE 30D7 M1PRNT LDX    #TTTPT
3073 BD 4330        JSR    NOTPRO
3076 7D 005B        TST    CKBRDR    TEST IF RESET
3079 26 3A          BNE    M5PRNS    YES,SET FAIL FLAG
307B 8D 18          BSR    MSPRNS
307D 25 55          BCS    MSPRNY
307F 5D             TST B
3080 2A 33          BPL    M5PRNS
3082 7D 005B        TST    CKBRDR    RESET?
3085 26 2E          BNE    M5PRNS
3087 4D      MSP9NT TST A
3088 2A 04          BPL    MSPRBT
308A 86 2B   MSP6NT LDA A  #$2B      LEFT SIDE PRINT
308C 20 02          BRA    MSPRAT
308E 86 43   MSPRBT LDA A  #$43      RIGHT SIDE PRINT
3090 BD 252D MSPRAT JSR    OUTXMT
3093 20 3F          BRA    MSPRNY
                 *
3095 BD 2460 MSPRNS JSR    BCDBIT
3098 25 1A          BCS    MSPRNX
309A 86 1E   MSPRN3 LDA A  #$1E
309C BD 252D        JSR    OUTXMT
309F 25 13          BCS    MSPRNX
30A1 86 FC          LDA A  #$FC
30A3 BD 252D        JSR    OUTXMT
30A6 25 0C          BCS    MSPRNX
30A8 86 07          LDA A  #$07      SET MODE
30AA BD 252D        JSR    OUTXMT
30AD 25 05          BCS    MSPRNX
30AF 96 68          LDA A  CKBRDP    LEFT RIGHT SIDE
30B1 16             TAB
30B2 48             ASL A
30B3 0C             CLC              RESET CARRY IF OK
30B4 39      MSPRNX RTS
                 *
30B5 BD 2460 M5PRNS JSR    BCDBIT
30B8 25 FA          BCS    MSPRNX
30BA 86 06          LDA A  #$06      PFLAG
30BC BD 252D        JSR    OUTXMT
30BF 25 F3          BCS    MSPRNX
30C1 86 C0          LDA A  #$C0
30C3 BD 252D        JSR    OUTXMT
30C6 25 EC          BCS    MSPRNX
30C8 86 07          LDA A  #$07
30CA BD 252D        JSR    OUTXMT
30CD 25 E5          BCS    MSPRNX
30CF 86 1B          LDA A  #$1B      FAIL FLAG
30D1 BD 252D        JSR    OUTXMT
30D4 0D      MSPRNY SEC
30D5 20 96          BRA    MSXRNY
                 *
30D7 33      TTTPT  FCB    $33,$35,$2A,$2F,$37,$00
30D8 35
30D9 2A
30DA 2F
30DB 37
30DC 00
```

```
01450 30DD 22                FCB     $22,$37,$00,$2E,$36,$FF
      30DE 37
      30DF 00
      30E0 2E
      30E1 36
      30E2 FF

01452                  * LIST PRINTERS OFF
01453 30E3 CE 30F8 M6PRNT LDX     #M4PRNT
01454 30E6 DF 64          STX     CKBRDZ
01455 30E8 CE 8210        LDX     #$8210
01456 30EB BD 4070        JSR     TSTTXT
01457 30EE 84 80   M3PRNT AND A   #$80
01458 30F0 BD 4175        JSR     TSTLST
01459 30F3 BD 40D0        JSR     TSTBIT
01460 30F6 20 F6          BRA     M3PRNT
01461                  *
01462 30F8 33      M4PRNT FCB     $33,$35,$2A,$2F,$37
      30F9 35
      30FA 2A
      30FB 2F
      30FC 37
01463 30FD 26             FCB     $26,$35,$36,$00,$32,$0C,$0C,$FF
      30FE 35
      30FF 36
      3100 00
      3101 32
      3102 0C
      3103 0C
      3104 FF

01466                  * SUSPEND CLEAR ROUTINE

01468 3105 27 03   SUSCLR BEQ     S1SCLR
01469 3107 7E 361B SUX2LS JMP     DUMMYK
01470                  *
01471 310A CE 3630 S1SCLR LDX     #TTTDK
01472 310D BD 4330        JSR     NOTPRD
01473 3110 8D 19          BSR     SUSCLU
01474 3112 25 14          BCS     SUS2LS
01475 3114 26 44          BNE     SUSCLT
01476 3116 86 07          LDA A   #$07
01477 3118 BD 252D SUSCLS JSR     OUTXMT
01478 311B 25 0B          BCS     SUS2LS
01479 311D 86 8B          LDA A   #$8B      DATA,M.S. BIT
01480 311F 8D 21          BSR     SUSCXY
01481 3121 25 05          BCS     SUS2LS
01482 3123 86 CB          LDA A   #$CB
01483 3125 BD 252D        JSR     OUTXMT
01484 3128 0D      SUS2LS SEC
01485 3129 20 DC          BRA     SUX2LS

01487 312B BD 2460 SUSCLU JSR     BCDBIT
01488 312E 25 11          BCS     SUSCLX
01489 3130 86 1E          LDA A   #$1E
01490 3132 BD 252D        JSR     OUTXMT    ACCESS DATAUR
01491 3135 25 0A          BCS     SUSCLX
01492 3137 86 F8          LDA A   #$F8
01493 3139 BD 252D        JSR     OUTXMT
01494 313C 25 03          BCS     SUSCLX
01495 313E 7D 005B        TST     CKBRDR    RESET ACTIVE?
01496 3141 39      SUSCLX RTS
01497 3142 BD 252D SUSCXY JSR     OUTXMT
01498 3145 25 FA          BCS     SUSCLX
01499 3147 86 16   SUSCXX LDA A   #$16
01500 3149 BD 252D        JSR     OUTXMT    ACCESS SUSFLAG
01501 314C 25 F3          BCS     SUSCLX
01502 314E 86 50          LDA A   #$50
01503 3150 BD 252D        JSR     OUTXMT
01504 3153 25 EC          BCS     SUSCLX
01505 3155 86 27          LDA A   #$27      RESET FLAGS
01506 3157 7E 252D        JMP     OUTXMT
01507                  *
```

```
01509 315A 86 27   SUSCLT LDA A  #$27      RESET BIT
01510 315C 20 BA           BRA    SUSCLS
01511              *
01513              * SUSPEND REMOVE SCORE
01514 315E 27 03   SUSRSC BEQ     S1SRSC
01515 3160 7E 3648 SUXRSF JMP     DUMMYL
01516              *
01517 3163 CE 365D S1SRSC LDX     #TTTDL
01518 3166 BD 4330         JSR     NOTPRO
01519 3169 8D C0           BSR     SUSCLU
01520 316B 25 18           BCS     SUSRSF
01521 316D 26 14           BNE     SUSRSE
01522 316F 86 07           LDA A   #$07
01523 3171 BD 252D SUSRSD JSR     OUTXMT
01524 3174 25 0F           BCS     SUSRSF
01525 3176 86 2B           LDA A   #$2B
01526 3178 8D C8           BSR     SUSCXY
01527 317A 25 09           BCS     SUSRSF
01528 317C 86 3B           LDA A   #$3B
01529 317E BD 252D         JSR     OUTXMT
01530 3181 20 02           BRA     SUSRSF
01531 3183 86 27   SUSRSE LDA A   #$27
01532 3185 0D      SUSRSF SEC
01533 3186 20 D8           BRA     SUXRSF
01535              *
01536              * ENABLE CLEAR
01537 3188 86 0F   DUMYG  LDA A   #$0F
01538 318A 97 4C           STA A   CKBRDH+2 SET TIMER
01539 318C 0E              CLI
01540 318D 7E 2668         JMP     CONTNB
01542              * INHIBIT OPEN/LEAGUE SELECTION
01543 3190 27 03   SUSOLS BEQ     S1SOL5
01544 3192 7E 36C5 SUXOLX JMP     DUMMYM
01545              *
01546 3195 CE 36DH S1SOL5 LDX     #TTTDO
01547 3198 BD 4330         JSR     NOTPRO
01548 319B 8D 03   S1SOLS BSR     SUXOLS
01549 319D 0D      SUSOLX SEC
01550 319E 20 FD           BRA     SUSOLX
01551              *
01552 31A0 BD 312B SUXOLS JSR     SUSCLU
01553 31A3 25 9C           BCS     SUSCLX
01554 31A5 26 0C           BNE     SUSOLU
01555 31A7 86 07           LDA A   #$07
01556 31A9 BD 252D SUSOLT JSR     OUTXMT
01557 31AC 25 93           BCS     SUSCLX
01558 31AE 86 1B           LDA A   #$1B
01559 31B0 7E 252D         JMP     OUTXMT
01560 31B3 86 27   SUSOLU LDA A   #$27
01561 31B5 20 F2           BRA     SUSOLT
01563              * MS REMOVE SCORE ROUTINE
01564 31B7 27 03   MSRSC  BEQ     M1RSC
01565 31B9 7E 4000 SX9OLX JMP     DUMMYP
01566              *
01567 31BC 7D 005A M1RSC  TST     CKBRDO+2
01568 31BF 27 05           BEQ     M1RSC6
01569 31C1 CE 3237         LDX     #TTTRMS
01570 31C4 20 03           BRA     M1RSC7
01571 31C6 CE 324A M1RSC6 LDX     #TTTRMC
01572 31C9 BD 4330 M1RSC7 JSR     NOTPRO
01573 31CC BD 32CA         JSR     MSPRN4
01574 31CF 25 20           BCS     SU9OLX
01575 31D1 48              ASL A
01576 31D2 48              ASL A
01577 31D3 BD 3320         JSR     MSPRN2
01578 31D6 25 19           BCS     SU9OLX
01579 31D8 5D              TST B
01580 31D9 2A 36           BPL     MSRSCB
01581 31DB 4D              TST A
01582 31DC 2A 16           BPL     MSRSCA
```

```
31DE 86 4B          LDA A  #$4B      LEFT SIDE
31E0 7D 005B        TST    CKBRDR
31E3 26 02          BNE    M2RSCA
31E5 8A 20          ORA A  #$20
31E7 BD 3142 M2RSCA JSR    SUSCXY
31EA 25 05          BCS    SU9DLX
31EC 86 1B          LDA A  #$1B
31EE BD 252D        JSR    OUTXMT
31F1 0D      SU9DLX SEC
31F2 20 C5          BRA    SX9DLX
31F4 7D 005B MSRSCA TST    CKBRDR
31F7 26 07          BNE    M3RSCA
31F9 86 43          LDA A  #$43
31FB BD 252D        JSR    OUTXMT
31FE 25 F1          BCS    SU9DLX
3200 86 83   M3RSCA LDA A  #$83
3202 BD 3142        JSR    SUSCXY
3205 25 07          BCS    MS9LRB    RIGHT SIDE
3207 86 2B          LDA A  #$2B
3209 BD 252D        JSR    OUTXMT
320C 20 E3          BRA    SU9DLX
                    *
320E 7E 32B3 MS9LRB JMP    MSCLRB
3211 96 5B   MSRSCB LDA A  CKBRDR
3213 26 02          BNE    M3RSCB
3215 8D 13          BSR    M4RSCB
3217 86 4B   M3RSCB LDA A  #$4B
3219 BD 252D        JSR    OUTXMT
321C 86 83          LDA A  #$83
321E BD 3142        JSR    SUSCXY
3221 25 EB          BCS    MS9LRB
3223 86 3B          LDA A  #$3B
3225 BD 252D        JSR    OUTXMT
3228 20 C7          BRA    SU9DLX

                    *
322A 86 2B   M4RSCB LDA A  #$2B      PRINT BOTH SIDES
322C BD 252D        JSR    OUTXMT
322F 25 05          BCS    M5RSCB
3231 86 43          LDA A  #$43
3233 BD 252D        JSR    OUTXMT
3236 39      M5RSCB RTS

                    *
3237 35      TTTRMS FCB    $35,$26,$2E,$32,$3A,$26
3238 26
3239 2E
323A 32
323B 3A
323C 26
323D 00             FCB    $00,$36,$24,$32,$35,$26,$00
323E 36
323F 24
3240 32
3241 35
3242 26
3243 00
3244 32             FCB    $32,$2F,$00,$2E,$36,$FF
3245 2F
3246 00
3247 2E
3248 36
3249 FF
                    *
324A 35      TTTRMC FCB    $35,$26,$2E,$32,$3A,$26
324B 26
324C 2E
324D 32
324E 3A
324F 26
```

```
01633 3250 00              FCB     $00,$36,$24,$32,$35,$26,$00
      3251 36
      3252 24
      3253 32
      3254 35
      3255 26
      3256 00
01634 3257 2A              FCB     $2A,$0C,$00,$22,$37,$37,$26,$2E
      3258 0C
      3259 00
      325A 22
      325B 37
      325C 37
      325D 26
      325E 2E
01635 325F 33              FCB     $33,$37,$26,$25,$FF
      3260 37
      3261 26
      3262 25
      3263 FF

01637                   * MS CLEAR ROUTINE

01639 3264 27 03   MSCLR  BEQ     M1CLR
01640 3266 7E 3756        JMP     DUMMYI
01641                   *
01642 3269 7D 005A M1CLR  TST     CKBRD0+2
01643 326C 27 05          BEQ     M1CLR6
01644 326E CE 3333        LDX     #TTTCLR
01645 3271 20 03          BRA     M1CLR7
01646 3273 CE 333C M1CLR6 LDX     #TTTCLC
01647 3276 BD 4330 M1CLR7 JSR     NOTPRD
01648 3279 BD 32CA        JSR     MSPRN4
01649 327C 25 35          BCS     MSCLRB
01650 327E BD 3320        JSR     MSPRN2
01651 3281 25 30          BCS     MSCLRB
01652 3283 5D             TST B
01653 3284 2A 31          BPL     MSCLRC
01654 3286 4D             TST A
01655 3287 2A 12          BPL     MSCLRA
01656 3289 86 8B          LDA A   #$8B      LEFT SIDE CLEAR
01657 328B 7D 005B        TST     CKBRDR
01658 328E 26 02          BNE     M2CLRA
01659 3290 8A 20          ORA A   #$20
01660 3292 BD 3142 M2CLRA JSR     SUSCXY
01661 3295 25 1C          BCS     MSCLRB
01662 3297 86 4B          LDA A   #$4B
01663 3299 20 15          BRA     MSCLRF
01664 329B 7D 005B MSCLRA TST     CKBRDR
01665 329E 26 07          BNE     M3CLRA
01666 32A0 86 43          LDA A   #$43
01667 32A2 BD 252D        JSR     OUTXMT
01668 32A5 25 0C          BCS     MSCLRB
01669 32A7 86 1B   M3CLRA LDA A   #$1B      RIGHT SIDE CLEAR
01670 32A9 BD 3142        JSR     SUSCXY
01671 32AC 25 05          BCS     MSCLRB
01672 32AE 86 8B          LDA A   #$8B      RESET FLAGS
01673 32B0 BD 252D MSCLRF JSR     OUTXMT
01674 32B3 0D      MSCLRB SEC
01675 32B4 7E 3756        JMP     DUMMYI
01676                   *
01677 32B7 7D 005B MSCLRC TST     CKBRDR
01678 32BA 26 03          BNE     M3CLRC
01679 32BC BD 322A        JSR     M4RSCB
01680 32BF 86 9B   M3CLRC LDA A   #$9B
01681 32C1 BD 3142        JSR     SUSCXY
01682 32C4 25 ED          BCS     MSCLRB    BOTH SIDES
01683 32C6 86 CB          LDA A   #$CB
01684 32C8 20 E6          BRA     MSCLRF
01685                   *
01686 32CA 7D 005A MSPRN4 TST     CKBRD0+2
```

```
01687 32CD 27 08          BEQ    MSPR44
01688 32CF BD 2460        JSR    BCDBIT
01689 32D2 25 46          BCS    MSPRN6
01690 32D4 86 FF          LDA A  #$FF
01691 32D6 39             RTS
01692                 *
01693 32D7 BD 2460 MSPR44 JSR    BCDBIT
01694 32DA 25 3E          BCS    MSPRN6    CLEAR SUSPENDED?
01695 32DC 96 68          LDA A  CKBRDP    ALL-UNITS ADDRESS?
01696 32DE 2A 3A          BPL    MSPRN6    YES,EXIT
01697 32E0 86 16          LDA A  #$16      ACCESS SUSFLAG
01698 32E2 BD 252D        JSR    OUTXMT
01699 32E5 25 33          BCS    MSPRN6
01700 32E7 86 50          LDA A  #$50
01701 32E9 BD 252D        JSR    OUTXMT
01702 32EC 25 2C          BCS    MSPRN6
01703 32EE 7F 005E        CLR    CKBRDT    CLEAR REPEART COUNTER
01704 32F1 86 0F   MSPRN9 LDA A  #$0F
01705 32F3 BD 252D        JSR    OUTXMT
01706 32F6 25 22          BCS    MSPRN6
01707 32F8 7C 005E        INC    CKBRDT
01708 32FB 86 02          LDA A  #$02      SET TIMER
01709 32FD 97 49          STA A  CKBRDG
01710 32FF B6 1020 MSPR12 LDA A  ACIAC
01711 3302 85 01          BIT A  #$01      INPUT?
01712 3304 26 0A          BNE    MSPRN8
01713                 *
01714 3306 BD 4245        JSR    PRINTR
01715 3309 7D 0049        TST    CKBRDG
01716 330C 26 F1          BNE    MSPR12
01717 330E 20 04          BRA    MSPR13
01718                 *
01719 3310 85 70   MSPRN8 BIT A  #$70      ERRORS?
01720 3312 27 08          BEQ    MSPR11    NO
01721 3314 96 5E   MSPR13 LDA A  CKBRDT
01722 3316 81 03          CMP A  #$03
01723 3318 2F D7          BLE    MSPRN9    REPEAT PROCESS
01724                 *
01725 331A 0D      MSPRN6 SEC               ERROR EXIT
01726 331B 39             RTS
01727                 *
01728 331C B6 1021 MSPR11 LDA A  ACIAD      GET CHARACTER
01729 331F 39             RTS
01730                 *
01731 3320 84 C0   MSPRN2 AND A  #$C0
01732 3322 D6 68          LDA B  CKBRDP
01733 3324 C4 40          AND B  #$40
01734 3326 26 02          BNE    MSPRN7    LEFT
01735 3328 C6 80          LDA B  #$80      RIGHT
01736 332A D7 58   MSPRN7 STA B  CKBRDQ
01737 332C 95 58          BIT A  CKBRDQ
01738 332E 27 EA          BEQ    MSPRN6
01739 3330 7E 309A        JMP    MSPRN3
01740                 *

01742                 *
01743 3333 24      TTTCLR FCB    $24,$2D,$26,$22,$35,$00
      3334 2D
      3335 26
      3336 22
      3337 35
      3338 00
01744 3339 2E             FCB    $2E,$36,$FF
      333A 36
      333B FF
01745                 *
01746 333C 24      TTTCLC FCB    $24,$2D,$26,$22,$35,$00
      333D 2D
      333E 26
      333F 22
      3340 35
      3341 00
```

```
01747 3342 2A              FCB    $2A,$0C,$00,$24,$2D,$26,$22,$35
      3343 0C
      3344 00
      3345 24
      3346 2D
      3347 26
      3348 22
      3349 35
01748 334A 00              FCB    $00,$22,$37,$37,$26,$2E,$37
      334B 22
      334C 37
      334D 37
      334E 26
      334F 2E
      3350 37
01749 3351 26              FCB    $26,$25,$FF
      3352 25
      3353 FF

01751                 * AUTOMITIC SEQUENCING CONTROL

01753 3354 27 03   NAUTO  BEQ    N1UTO
01754 3356 7E 35C7 NAXTOX JMP    DUMMYG
01755                 *
01756 3359 CE 35DC N1UTO  LDX    #TTTDG
01757 335C BD 4330         JSR    NOTPRO
01758 335F BD 312B         JSR    SUSCLU
01759 3362 25 0E           BCS    NAUTOX
01760 3364 26 0F           BNE    NAUTOA
01761 3366 86 07           LDA A  #$07
01762 3368 BD 252D NAUTOB JSR    OUTXMT
01763 336B 25 05           BCS    NAUTOX
01764 336D 86 13           LDA A  #$13      DATA
01765 336F BD 252D         JSR    OUTXMT
01766 3372 0D      NAUTOX SEC
01767 3373 20 E1           BRA    NAXTOX

01769 3375 86 27   NAUTOA LDA A  #$27
01770 3377 20 EF           BRA    NAUTOB

01773                 * DISABLE PRINTER AT M.S.
01774 3379 27 03   DUMMYV BEQ    D1MMYV
01775 337B 7E 33AF D7XMYV JMP    D2MMYV
01776                 *
01777 337E CE 33C4 D1MMYV LDX    #D6MMYV
01778 3381 BD 4330         JSR    NOTPRO
01779 3384 BD 2460         JSR    BCDBIT
01780 3387 25 1F           BCS    D7MMYV
01781 3389 86 06           LDA A  #$06      PFLAG $70
01782 338B BD 252D         JSR    OUTXMT
01783 338E 25 18           BCS    D7MMYV
01784 3390 86 C0           LDA A  #$C0
01785 3392 BD 252D         JSR    OUTXMT
01786 3395 25 11           BCS    D7MMYV
01787 3397 7D 005B         TST    CKBRDR
01788 339A 26 0F           BNE    D3MMYV
01789 339C 86 07           LDA A  #$07
01790 339E BD 252D D4MMYV JSR    OUTXMT
01791 33A1 25 05           BCS    D7MMYV
01792 33A3 86 2B           LDA A  #$2B
01793 33A5 BD 252D         JSR    OUTXMT
01794 33A8 0D      D7MMYV SEC
01795 33A9 20 D0           BRA    D7XMYV
01796                 *
01797 33AB 86 27   D3MMYV LDA A  #$27
01798 33AD 20 EF           BRA    D4MMYV
01799                 *
01800 33AF CE 33C4 D2MMYV LDX    #D6MMYV
01801 33B2 DF 64           STX    CKBRDZ
01802 33B4 CE 0006         LDX    #06C0
01803 33B7 BD 4070         JSR    TSTTXT
01804 33BA 84 10   D5MMYV AND A  #$10
```

```
33BC BD 4175          JSR    TSTLST
33BF BD 40D0          JSR    TSTBIT
33C2 20 F6            BRA    D5MMYV
                 *
33C4 2E          D6MMYV FCB  $2E,$36,$00,$3B,$2A,$37,$28,$00
33C5 36
33C6 00
33C7 3B
33C8 2A
33C9 37
33CA 28
33CB 00
33CC 33               FCB    $33,$35,$2A,$2F,$37,$26,$35,$36,$00,$
33CD 35
33CE 2A
33CF 2F
33D0 37
33D1 26
33D2 35
33D3 36
33D4 00
33D5 37
33D6 38               FCB    $38,$35,$2F,$26,$25,$00,$32,$0C,$0C,$
33D7 35
33D8 2F
33D9 26
33DA 25
33DB 00
33DC 32
33DD 0C
33DE 0C
33DF FF

                 * DISABLE LANE SIDE
33E0 27 03       DUMYLN BEQ  D1MYLN
33E2 7E 4038     D7XYLN JMP  D2MYLN
                 *
33E5 CE 4056     D1MYLN LDX  #TTTLNI
33E8 BD 4330          JSR    NOTPRO
33EB BD 2460          JSR    BCDBIT
33EE 25 29            BCS    D7MYLN
33F0 86 1E            LDA A  #$1E      DATAVS LOCATION
33F2 BD 252D          JSR    OUTXMT
33F5 25 22            BCS    D7MYLN
33F7 86 FC            LDA A  #$FC
33F9 BD 252D          JSR    OUTXMT
33FC 25 1B            BCS    D7MYLN
33FE 7D 005B          TST    CKBRDR
3401 26 19            BNE    D3MYLN
3403 86 07            LDA A  #$07
3405 BD 252D     D5MYLN JSR  OUTXMT
3408 25 0F            BCS    D7MYLN
340A D6 68            LDA B  CKBRDP    TEST L/R ADDRESS
340C C5 40            BIT B  #$40
340E 27 04            BEQ    D6MYLN
3410 86 13            LDA A  #$13      LEFT LANE
3412 20 02            BRA    D4MYLN
3414 86 23       D6MYLN LDA A  #$23    RIGHT LANE
3416 BD 252D     D4MYLN JSR  OUTXMT
3419 0D          D7MYLN SEC
341A 20 C6            BRA    D7XYLN
341C 86 27       D3MYLN LDA A  #$27
341E 20 E5            BRA    D5MYLN

                 * ADVERTISE CONTROL

3420 BD 2460     ADVTSE JSR  BCDBIT
3423 25 1F            BCS    ADVTSK
3425 86 82            LDA A  #$82      PIA1AD POINTER
3427 BD 252D          JSR    OUTXMT
```

```
01850 342A 25 18          BCS    ADVTSK
01851 342C 86 10          LDA A  #$10
01852 342E BD 252D        JSR    OUTXMT
01853 3431 25 11          BCS    ADVTSK
01854 3433 7D 005B        TST    CKBRDR
01855 3436 26 0F          BNE    ADVTSF
01856 3438 86 07          LDA A  #$07      SET
01857 343A BD 252D ADVTSG JSR    OUTXMT
01858 343D 25 05          BCS    ADVTSK
01859 343F 86 83          LDA A  #$83      DATA, LS BYTE
01860 3441 BD 252D        JSR    OUTXMT
01861 3444 7E 2660 ADVTSK JMP    CONTNU

01863 3447 86 27   ADVTSF LDA A  #$27      RESET
01864 3449 20 EF          BRA    ADVTSG

01867              *****************************
01868              * UTILITY SUBROUTINES FOR POLLER

01870 344B BD 252D INITY2 JSR    OUTXMT
01871 344E 25 1A          BCS    INITY2
01872 3450 86 16          LDA A  #$16      ACCESS SUSFLAG
01873 3452 BD 252D        JSR    OUTXMT
01874 3455 25 13          BCS    INITY2
01875 3457 86 50          LDA A  #$50
01876 3459 BD 252D        JSR    OUTXMT
01877 345C 25 0C          BCS    INITY2
01878 345E 86 67          LDA A  #$67      GET BIT TEST MODE
01879 3460 BD 252D        JSR    OUTXMT
01880 3463 25 05          BCS    INITY2
01881 3465 86 FB          LDA A  #$FB      HIGH ORDER TEST BITS
01882 3467 7E 252D        JMP    OUTXMT
01883 346A 39      INITY2 RTS

01887              *
01888              * OPEN/LEAGUE SELECT
01889 346B 27 03   OPEN   BEQ    O1EN
01890 346D 7E 3523 OPXNT2 JMP    TSTOPN
01891              *
01892 3470 CE 3538 O1EN   LDX    #TTTOPN
01893 3473 BD 4330        JSR    NOTPRO
01894 3476 8D 03          BSR    O2EN
01895 3478 0D      OPENT2 SEC
01896 3479 20 F2          BRA    OPXNT2
01897              *
01898 347B 8D 2C   O2EN   BSR    OPENUT
01899 347D 25 EB          BCS    INITY2
01900 347F 86 07          LDA A  #$07
01901 3481 BD 252D        JSR    OUTXMT
01902 3484 25 E4          BCS    INITY2
01903 3486 86 83          LDA A  #$83
01904 3488 7E 252D        JMP    OUTXMT
01905              *
01906              *
01907 348B 27 03   LEAGUE BEQ    L1AGUE
01908 348D 7E 359F L2XGUE JMP    DUMMYJ
01909              *
01910 3490 CE 35B5 L1AGUE LDX    #TTTDJ
01911 3493 BD 4330        JSR    NOTPRO
01912 3496 8D 11          BSR    OPENUT
01913 3498 25 0C          BCS    L2AGUE
01914 349A 86 27          LDA A  #$27
01915 349C BD 252D        JSR    OUTXMT
01916 349F 25 05          BCS    L2AGUE
01917 34A1 86 83          LDA A  #$83
01918 34A3 BD 252D        JSR    OUTXMT
01919 34A6 0D      L2AGUE SEC
01920 34A7 20 E4          BRA    L2XGUE
01921              *
01922 34A9 BD 31A0 OPENUT JSR    SUXOLS
01923 34AC 25 BC          BCS    INITY2
```

```
01924 34AE 86 82          LDA A  #$82
01925 34B0 BD 252D        JSR    OUTXMT
01926 34B3 25 B5          BCS    INITY2
01927 34B5 86 14          LDA A  #$14
01928 34B7 7E 252D        JMP    OUTXMT

01930                 ********************************
01931                 *** SELECT LISTING MODE
01932 34BA 86 FF      DUMSP  LDA A  #$FF
01933 34BC 97 4A             STA A  CKBRDH
01934 34BE 96 4B             LDA A  CKBRDH+1
01935 34C0 8A 0F             ORA A  #$0F
01936 34C2 97 4B             STA A  CKBRDH+1
01937 34C4 8D 04             BSR    REXET     DISPLAY TEXT
01938 34C6 0E                CLI
01939 34C7 7E 2668           JMP    CONTNB
01940                 *
01941 34CA BD 223C    REXET  JSR    RA2ET     DISPLAY TEXT
01942 34CD CE 0101           LDX    #$101
01943 34D0 DF 51             STX    CKBRDL-1
01944 34D2 96 4B             LDA A  CKBRDH+1
01945 34D4 85 0F             BIT A  #$0F
01946 34D6 26 0D             BNE    REXET2
01947 34D8 85 F0      REXET1 BIT A  #$F0
01948 34DA 26 15             BNE    REXET3
01949 34DC CE 3519    REXET5 LDX    #TTREXD
01950 34DF DF 64             STX    CKBRDZ
01951 34E1 BD 40DB           JSR    TSTTAT
01952 34E4 39                RTS
01953 34E5 CE 3507    REXET2 LDX    #TTREXA
01954 34E8 DF 64             STX    CKBRDZ
01955 34EA BD 40DB           JSR    TSTTAT
01956 34ED 96 4B             LDA A  CKBRDH+1
01957 34EF 20 E7             BRA    REXET1
01958 34F1 85 0F      REXET3 BIT A  #$0F
01959 34F3 27 08             BEQ    REXET4
01960 34F5 CE 350D           LDX    #TTREXB
01961 34F8 DF 64             STX    CKBRDZ
01962 34FA BD 40DB           JSR    TSTTAT
01963 34FD CE 3512    REXET4 LDX    #TTREXC
01964 3500 DF 64             STX    CKBRDZ
01965 3502 BD 40DB           JSR    TSTTAT
01966 3505 20 D5             BRA    REXET5
01967                 *
01968 3507 2D         TTREXA FCB    $2D,$2A,$36,$37,$00,$FF
      3508 2A
      3509 36
      350A 37
      350B 00
      350C FF
01969 350D 22         TTREXB FCB    $22,$2F,$25,$00,$FF
      350E 2F
      350F 25
      3510 00
      3511 FF
01970 3512 35         TTREXC FCB    $35,$26,$36,$26,$37,$00,$FF
      3513 26
      3514 36
      3515 26
      3516 37
```

I claim;

1. A bowling scoring system for a plurality of pairs of bowling lanes including a manager's console unit comprising a keyboard, a memory means, a processing unit connected to said keyboard and said memory means for developing address and command information for storing into said memory means, a character generator connected to said memory means, and a CRT monitor coupled to said character generator for displaying information based on the key depressed on said keyboard, a plurality of lane score terminals each comprising memory means for storing bowler lane and game score information, a processing unit for processing said information, a CRT monitor responsive to a character generator coupled to said memory means for displaying the output of said processing unit, a plurality of communication buses for connecting said manager's console and said score terminals in parallel each of said score terminals including in said memory means a plurality of addressable flag registers and a pointer register, said manager's console including means for transmitting the address of one of said flag registers to said pointer register and for transmitting a command to said processing unit at said lane score terminal in response to key depressions at said keyboard at said manager's console, said lane score terminal being responsive to said command from said manager's console to read the register address of one of said plurality of addressable registers stored at said pointer register and to operate on said addressed register as required by said command code, whereby the lane score terminal is responsive to said commands from said manager's console unit to modify said processing of said information at said lane score terminal.

2. A system as claimed in claim 1 wherein said manager's console unit comprises means for transmitting an address to all of said lane score terminals, each of said terminal processing units comprising means for individually establishing a terminal identity address, and means for comparing said received address word with said address established by said identity means, said terminal processing unit being responsive to said pointer register address and said command word when said address transmitted matches said local identity address, whereby said manager's console may selectively address any one of said lane score terminals.

3. A system as claimed in claim 2 wherein said word sequence transmitted from said manager's console to said lane score terminals further comprises a data word including a plurality of significant bit locations, said data word identifying by the significant bits included in the data word the significant bit locations in the addressable flag register specified by said pointer register, whereby a flag bit may be set in one significant bit location in said flag register addressed by said pointer register on command from said manager's console, thereby altering the function of said lane score terminal.

4. A manager's console unit for a bowling establishment having a plurality of bowling lanes and an addressable terminal at each pair of said lanes, each terminal comprising at least a processing unit, a random access memory having addressable game score data registers, addressable flag registers and a pointer register, said manager's console unit comprising a command keyboard, a memory for storing command codes from said keyboard and game score information from said terminals, a manager's processing unit connected to said memory and to said terminals for communicating with said addressable scoring terminals and having means for processing game score information from said memory and for processing command codes to be sent to said terminals, said manager's console being connected by a bus means to each of said addressable scoring terminals, said manager's console including means for transmitting one of said command codes in said memory comprising the address of an addressable data or flag register to a pointer register at one of said terminals, and for transmitting a commandd code to said terminal for defining the operation to be performed by said terminal processing unit on the bits stored at said addressable register.

5. A console unit as claimed in claim 4 wherein said transmitted command comprises an address code for designating one or more of said addressable scoring terminals to receive said register address and said command code.

6. A console unit as claimed in claim 5 wherein said address code addresses all of said scoring terminals, said addressable register comprising means for storing a bit indicating the open-league status of said terminal, and said command code causes said processing unit of said scoring terminals to respond to said addressed register to transfer an indicator of open-league status to said manager's console unit for display at said console.

7. A console unit as claimed in claim 6 wherein said keyboard includes key means for defining a plurality of scoring terminals to be addressed, said address code being automatically incremented by said processing unit to cause said manager's console to address, in turn, each of said defined plurality of terminals.

8. A console unit as claimed in claim 6 wherein said keyboard includes first key means for defining a plurality of scoring terminals to be addressed and seond key means for successively incrementing said address word, said manager's console thereby addressing, in turn, each of said plurality of terminals.

9. A console unit as claimed in claim 4 wherein said transmitted command comprises an address code for designating one of said addressable scoring terminals to receive said register address and said command code, said register address comprising the address of the first register holding game score data, said command code initiating a transfer of the contents of the addressed register and incrementing of said register address after each said transfer, whereby the game score data for a lane at said addressable score terminal is transferred to said manager's console unit.

* * * * *

UNITED STATES PATENT AND TRADEMARK OFFICE

CERTIFICATE OF CORRECTION

PATENT NO. : 4,131,948

DATED : December 26, 1978

INVENTOR(S) : Reginald A. Kaenel

It is certified that error appears in the above-identified patent and that said Letters Patent are hereby corrected as shown below:

Column 4, line 52, "D8" should read --- D7 --.
Column 5, line 26, "Magic Score" should read --- lane scoring console ---.
Column 5, line 30, "Magic Score unit" should read --- lane scoring console ---.
Column 5, line 36, "Magic Score" should read --- lane scoring console ---.
Column 7, line 11, "74 and 76" should read --- 82 and 83 ---
Column 7, line 26, "had" should read --- has ---.
Column 7, line 68, "84" should read --- 87 ---.
Column 8, line 2, "84" should read --- 87 ---.
Column 8, line 15, "register" should read --- registers ---.
Column 8, line 35, "24L" should read --- 24R ---.
Column 8, line 36, after "The" should read --- horizontal and ---.
Column 8, line 40, "decoder" should read --- synch. generator
Column 11, line 32, "microswitches 140" (both occurrences) dhoulf read --- identity switches 56 --.
Column 11, line 34, "44" should read --- 40 ---.
Column 11, line 36, "microswitches 140" should read --- identity switches 56 ---.
Column 12, line 20, "44" should read --- 40 ---.
Column 13, line 30, "Magic Score" should read --- lane ---.
Column 13, line 64, "Magic Score" should read --- lane ---.
Column 15, line 7, "44" should read --- 40 ---.

UNITED STATES PATENT AND TRADEMARK OFFICE

CERTIFICATE OF CORRECTION

PATENT NO. : 4,131,948

DATED : December 26, 1978

INVENTOR(S) : Reginald A. Kaenel

It is certified that error appears in the above-identified patent and that said Letters Patent are hereby corrected as shown below:

In the Drawings:

Fig. 5A:

On the right side of the drawing, add the reference numeral 72 to the OR gate whose output line is labeled "GO/HALT".

At the bottom right corner of the drawing add the reference numeral 92 to the block having the AND sign therein.

Fig. 6:

In the center portion of the drawing, to the left of transistor $Q_1$, add the reference numeral 134 to the gate.

Signed and Sealed this

Twentieth Day of November 1979

[SEAL]

Attest:

RUTH C. MASON
Attesting Officer

LUTRELLE F. PARKER
Acting Commissioner of Patents and Trademarks